US008620662B2

(12) United States Patent
Bellegarda

(10) Patent No.: US 8,620,662 B2
(45) Date of Patent: Dec. 31, 2013

(54) CONTEXT-AWARE UNIT SELECTION

(75) Inventor: Jerome Bellegarda, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 903 days.

(21) Appl. No.: 11/986,515

(22) Filed: Nov. 20, 2007

(65) Prior Publication Data

US 2009/0132253 A1 May 21, 2009

(51) Int. Cl.
*G10L 13/08* (2013.01)

(52) U.S. Cl.
USPC ..... 704/260

(58) Field of Classification Search
USPC ..... 704/1–10, 257–269
See application file for complete search history.

(56) References Cited

U.S. PATENT DOCUMENTS

| | | | |
|---|---|---|---|
| 3,704,345 | A | 11/1972 | Coker et al. |
| 3,828,132 | A | 8/1974 | Flanagan et al. |
| 3,979,557 | A | 9/1976 | Schulman et al. |
| 4,278,838 | A | 7/1981 | Antonov |
| 4,282,405 | A | 8/1981 | Taguchi |
| 4,310,721 | A | 1/1982 | Manley et al. |
| 4,348,553 | A | 9/1982 | Baker et al. |
| 4,653,021 | A | 3/1987 | Takagi |
| 4,688,195 | A | 8/1987 | Thompson et al. |
| 4,692,941 | A | 9/1987 | Jacks et al. |
| 4,718,094 | A | 1/1988 | Bahl et al. |
| 4,724,542 | A | 2/1988 | Williford |
| 4,726,065 | A | 2/1988 | Froessl |
| 4,727,354 | A | 2/1988 | Lindsay |
| 4,776,016 | A | 10/1988 | Hansen |
| 4,783,807 | A | 11/1988 | Marley |
| 4,811,243 | A | 3/1989 | Racine |
| 4,819,271 | A | 4/1989 | Bahl et al. |
| 4,827,520 | A | 5/1989 | Zeinstra |

(Continued)

FOREIGN PATENT DOCUMENTS

| | | | |
|---|---|---|---|
| DE | 3837590 | A1 | 5/1990 |
| DE | 198 41 541 | B4 | 12/2007 |

(Continued)

OTHER PUBLICATIONS

Hunt, Andrew J., et al., "Unit Selection in a Concatenative Speech Synthesis System Using a Large Speech Database", Copyright 1996 IEEE. "To appear in Proc. ICASSP-96, May 7-10, Atlanta, GA" ATR Interpreting Telecommunications Research Labs, Kyoto Japan. 4 pages.

(Continued)

*Primary Examiner* — Abul Azad
(74) *Attorney, Agent, or Firm* — Morgan, Lewis & Bockius LLP

(57) ABSTRACT

Methods and apparatuses to perform context-aware unit selection for natural language processing are described. Streams of information associated with input units are received. The streams of information are analyzed in a context associated with first candidate units to determine a first set of weights of the streams of information. A first candidate unit is selected from the first candidate units based on the first set of weights of the streams of information. The streams of information are analyzed in the context associated with second candidate units to determine a second set of weights of the streams of information. A second candidate unit is selected from second candidate units to concatenate with the first candidate unit based on the second set of weights of the streams of information.

21 Claims, 8 Drawing Sheets

(56) References Cited

U.S. PATENT DOCUMENTS 4,829,576 A 5/1989 Porter
4,833,712 A 5/1989 Bahl et al.
4,839,853 A 6/1989 Deerwester et al.
4,852,168 A 7/1989 Sprague
4,862,504 A 8/1989 Nomura
4,878,230 A 10/1989 Murakami et al.
4,903,305 A 2/1990 Gillick et al.
4,905,163 A 2/1990 Garber et al.
4,914,586 A 4/1990 Swinehart et al.
4,944,013 A 7/1990 Gouvianakis et al.
4,965,763 A 10/1990 Zamora
4,974,191 A 11/1990 Amirghodsi et al.
4,977,598 A 12/1990 Doddington et al.
4,992,972 A 2/1991 Brooks et al.
5,010,574 A 4/1991 Wang
5,020,112 A 5/1991 Chou
5,021,971 A 6/1991 Lindsay
5,022,081 A 6/1991 Hirose et al.
5,027,406 A 6/1991 Roberts et al.
5,031,217 A 7/1991 Nishimura
5,032,989 A 7/1991 Tornetta
5,040,218 A 8/1991 Vitale et al.
5,072,452 A 12/1991 Brown et al.
5,091,945 A 2/1992 Kleijn
5,127,053 A 6/1992 Koch
5,127,055 A 6/1992 Larkey
5,128,672 A 7/1992 Kaehler
5,133,011 A 7/1992 McKiel, Jr.
5,142,584 A 8/1992 Ozawa
5,164,900 A 11/1992 Bernath
5,165,007 A 11/1992 Bahl et al.
5,179,652 A 1/1993 Rozmanith et al.
5,194,950 A 3/1993 Murakami et al.
5,199,077 A 3/1993 Wilcox et al.
5,202,952 A 4/1993 Gillick et al.
5,208,862 A 5/1993 Ozawa
5,216,747 A 6/1993 Hardwick et al.
5,220,639 A 6/1993 Lee
5,220,657 A 6/1993 Bly et al.
5,222,146 A 6/1993 Bahl et al.
5,230,036 A 7/1993 Akamine et al.
5,235,680 A 8/1993 Bijnagte
5,267,345 A 11/1993 Brown et al.
5,268,990 A 12/1993 Cohen et al.
5,282,265 A 1/1994 Suda et al.
RE34,562 E 3/1994 Murakami et al.
5,291,286 A 3/1994 Murakami et al.
5,293,448 A 3/1994 Honda
5,293,452 A 3/1994 Picone et al.
5,297,170 A 3/1994 Eyuboglu et al.
5,301,109 A 4/1994 Landauer et al.
5,303,406 A 4/1994 Hansen et al.
5,317,507 A 5/1994 Gallant
5,317,647 A 5/1994 Pagallo
5,325,297 A 6/1994 Bird et al.
5,325,298 A 6/1994 Gallant
5,327,498 A 7/1994 Hamon
5,333,236 A 7/1994 Bahl et al.
5,333,275 A 7/1994 Wheatley et al.
5,345,536 A 9/1994 Hoshimi et al.
5,349,645 A 9/1994 Zhao
5,353,377 A 10/1994 Kuroda et al.
5,377,301 A 12/1994 Rosenberg et al.
5,384,892 A 1/1995 Strong
5,384,893 A 1/1995 Hutchins
5,386,494 A 1/1995 White
5,386,556 A 1/1995 Hedin et al.
5,390,279 A 2/1995 Strong
5,396,625 A 3/1995 Parkes
5,400,434 A 3/1995 Pearson
5,424,947 A 6/1995 Nagao et al.
5,434,777 A 7/1995 Luciw
5,455,888 A 10/1995 Iyengar et al.
5,469,529 A 11/1995 Bimbot et al.
5,475,587 A 12/1995 Anick et al.
5,479,488 A 12/1995 Lennig et al.
5,491,772 A 2/1996 Hardwick et al.
5,502,790 A 3/1996 Yi
5,502,791 A 3/1996 Nishimura et al.
5,515,475 A 5/1996 Gupta et al.
5,536,902 A 7/1996 Serra et al.
5,574,823 A 11/1996 Hassanein et al.
5,577,241 A 11/1996 Spencer
5,579,436 A 11/1996 Chou et al.
5,581,655 A 12/1996 Cohen et al.
5,596,676 A 1/1997 Swaminathan et al.
5,608,624 A 3/1997 Luciw
5,610,812 A 3/1997 Schabes et al.
5,613,036 A 3/1997 Strong
5,617,507 A 4/1997 Lee et al.
5,621,859 A 4/1997 Schwartz et al.
5,642,464 A 6/1997 Yue et al.
5,642,519 A 6/1997 Martin
5,664,055 A 9/1997 Kroon
5,675,819 A 10/1997 Schuetze
5,682,539 A 10/1997 Conrad et al.
5,687,077 A 11/1997 Gough, Jr.
5,712,957 A 1/1998 Waibel et al.
5,727,950 A 3/1998 Cook et al.
5,729,694 A 3/1998 Holzrichter et al.
5,732,390 A 3/1998 Katayanagi et al.
5,734,791 A 3/1998 Acero et al.
5,748,974 A 5/1998 Johnson
5,790,978 A 8/1998 Olive et al.
5,794,050 A 8/1998 Dahlgren et al.
5,794,182 A 8/1998 Manduchi et al.
5,799,276 A 8/1998 Komissarchik et al.
5,826,261 A 10/1998 Spencer
5,828,999 A 10/1998 Bellegarda et al.
5,835,893 A 11/1998 Ushioda
5,839,106 A 11/1998 Bellegarda
5,860,063 A 1/1999 Gorin et al.
5,864,806 A 1/1999 Mokbel et al.
5,867,799 A 2/1999 Lang et al.
5,873,056 A 2/1999 Liddy et al.
5,895,466 A 4/1999 Goldberg et al.
5,899,972 A 5/1999 Miyazawa et al.
5,913,193 A 6/1999 Huang et al.
5,915,249 A 6/1999 Spencer
5,943,670 A 8/1999 Prager
5,987,404 A 11/1999 Della Pietra et al.
6,016,471 A 1/2000 Kuhn et al.
6,029,132 A 2/2000 Kuhn et al.
6,038,533 A 3/2000 Buchsbaum et al.
6,052,656 A 4/2000 Suda et al.
6,064,960 A 5/2000 Bellegarda et al.
6,081,750 A 6/2000 Hoffberg et al.
6,088,731 A 7/2000 Kiraly et al.
6,108,627 A 8/2000 Sabourin
6,122,616 A 9/2000 Henton
6,144,938 A 11/2000 Surace et al.
6,173,261 B1 1/2001 Arai et al.
6,188,999 B1 2/2001 Moody
6,195,641 B1 2/2001 Loring et al.
6,208,971 B1 3/2001 Bellegarda et al.
6,233,559 B1 5/2001 Balakrishnan
6,246,981 B1 6/2001 Papineni et al.
6,266,637 B1 7/2001 Donovan et al.
6,285,786 B1 9/2001 Seni et al.
6,308,149 B1 10/2001 Gaussier et al.
6,317,594 B1 11/2001 Gossman et al.
6,317,707 B1 11/2001 Bangalore et al.
6,317,831 B1 11/2001 King
6,321,092 B1 11/2001 Fitch et al.
6,334,103 B1 12/2001 Surace et al.
6,356,854 B1 3/2002 Schubert et al.
6,366,883 B1 * 4/2002 Campbell et al. ..... 704/260
6,366,884 B1 4/2002 Bellegarda et al.
6,421,672 B1 7/2002 McAllister et al.
6,434,524 B1 8/2002 Weber
6,446,076 B1 9/2002 Burkey et al.
6,453,292 B2 9/2002 Ramaswamy et al.
6,466,654 B1 10/2002 Cooper et al.
6,477,488 B1 11/2002 Bellegarda

(56) References Cited

U.S. PATENT DOCUMENTS 6,487,534 B1 11/2002 Thelen et al.
6,499,013 B1 12/2002 Weber
6,501,937 B1 12/2002 Ho et al.
6,505,158 B1 1/2003 Conkie
6,513,063 B1 1/2003 Julia et al.
6,523,061 B1 2/2003 Halverson et al.
6,526,395 B1 2/2003 Morris
6,532,444 B1 3/2003 Weber
6,532,446 B1 3/2003 King
6,553,344 B2 4/2003 Bellegarda et al.
6,598,039 B1 7/2003 Livowsky
6,601,026 B2 7/2003 Appelt et al.
6,604,059 B2 8/2003 Strubbe et al.
6,615,172 B1 9/2003 Bennett et al.
6,615,175 B1 9/2003 Gazdzinski
6,631,346 B1 10/2003 Karaorman et al.
6,633,846 B1 10/2003 Bennett et al.
6,647,260 B2 11/2003 Dusse et al.
6,650,735 B2 11/2003 Burton et al.
6,654,740 B2 11/2003 Tokuda et al.
6,665,639 B2 12/2003 Mozer et al.
6,665,640 B1 12/2003 Bennett et al.
6,665,641 B1 12/2003 Coorman et al.
6,684,187 B1 1/2004 Conkie
6,691,111 B2 2/2004 Lazaridis et al.
6,691,151 B1 2/2004 Cheyer et al.
6,697,780 B1 2/2004 Beutnagel et al.
6,735,632 B1 5/2004 Kiraly et al.
6,742,021 B1 5/2004 Halverson et al.
6,757,362 B1 6/2004 Cooper et al.
6,757,718 B1 6/2004 Halverson et al.
6,778,951 B1 8/2004 Contractor
6,778,952 B2 8/2004 Bellegarda
6,778,962 B1 8/2004 Kasai et al.
6,792,082 B1 9/2004 Levine
6,807,574 B1 10/2004 Partovi et al.
6,810,379 B1 10/2004 Vermeulen et al.
6,813,491 B1 11/2004 McKinney
6,832,194 B1 12/2004 Mozer et al.
6,842,767 B1 1/2005 Partovi et al.
6,847,966 B1 1/2005 Sommer et al.
6,851,115 B1 2/2005 Cheyer et al.
6,859,931 B1 2/2005 Cheyer et al.
6,873,986 B2 * 3/2005 McConnell et al. ..... 704/8
6,877,003 B2 * 4/2005 Ho et al. ..... 704/8
6,895,380 B2 5/2005 Sepe, Jr.
6,895,558 B1 5/2005 Loveland
6,910,004 B2 6/2005 Tarbouriech et al.
6,912,499 B1 6/2005 Sabourin et al.
6,928,614 B1 8/2005 Everhart
6,937,975 B1 8/2005 Elworthy
6,937,986 B2 8/2005 Denenberg et al.
6,964,023 B2 11/2005 Maes et al.
6,980,949 B2 12/2005 Ford
6,980,955 B2 12/2005 Okutani et al.
6,985,865 B1 1/2006 Packingham et al.
6,988,071 B1 1/2006 Gazdzinski
6,996,531 B2 2/2006 Korall et al.
6,999,925 B2 * 2/2006 Fischer et al. ..... 704/243
6,999,927 B2 2/2006 Mozer et al.
7,020,685 B1 3/2006 Chen et al.
7,027,974 B1 4/2006 Busch et al.
7,036,128 B1 4/2006 Julia et al.
7,043,422 B2 * 5/2006 Gao et al. ..... 704/9
7,047,193 B1 5/2006 Bellegarda
7,050,977 B1 5/2006 Bennett
7,058,569 B2 6/2006 Coorman et al.
7,062,428 B2 6/2006 Hogenhout et al.
7,069,560 B1 6/2006 Cheyer et al.
7,092,887 B2 8/2006 Mozer et al.
7,092,928 B1 8/2006 Elad et al.
7,093,693 B1 8/2006 Gazdzinski
7,127,046 B1 10/2006 Smith et al.
7,136,710 B1 11/2006 Hoffberg et al.
7,137,126 B1 11/2006 Coffman et al.
7,139,714 B2 11/2006 Bennett et al.
7,139,722 B2 11/2006 Perrella et al.
7,177,798 B2 2/2007 Hsu et al.
7,177,817 B1 * 2/2007 Khosla et al. ..... 704/275
7,197,460 B1 3/2007 Gupta et al.
7,200,559 B2 4/2007 Wang
7,203,646 B2 4/2007 Bennett
7,216,073 B2 5/2007 Lavi et al.
7,216,080 B2 5/2007 Tsiao et al.
7,225,125 B2 5/2007 Bennett et al.
7,233,790 B2 6/2007 Kjellberg et al.
7,233,904 B2 6/2007 Luisi
7,266,496 B2 9/2007 Wang et al.
7,277,854 B2 10/2007 Bennett et al.
7,290,039 B1 10/2007 Lisitsa et al.
7,299,033 B2 11/2007 Kjellberg et al.
7,310,600 B1 12/2007 Garner et al.
7,324,947 B2 1/2008 Jordan et al.
7,349,953 B2 3/2008 Lisitsa et al.
7,376,556 B2 5/2008 Bennett
7,376,645 B2 5/2008 Bernard
7,379,874 B2 5/2008 Schmid et al.
7,386,449 B2 6/2008 Sun et al.
7,392,185 B2 6/2008 Bennett
7,398,209 B2 7/2008 Kennewick et al.
7,403,938 B2 7/2008 Harrison et al.
7,409,337 B1 8/2008 Potter et al.
7,415,100 B2 8/2008 Cooper et al.
7,418,392 B1 8/2008 Mozer et al.
7,426,467 B2 9/2008 Nashida et al.
7,427,024 B1 9/2008 Gazdzinski et al.
7,447,635 B1 11/2008 Konopka et al.
7,454,351 B2 11/2008 Jeschke et al.
7,467,087 B1 * 12/2008 Gillick et al. ..... 704/260
7,475,010 B2 1/2009 Chao
7,483,894 B2 1/2009 Cao
7,487,089 B2 2/2009 Mozer
7,496,498 B2 2/2009 Chu et al.
7,496,512 B2 2/2009 Zhao et al.
7,502,738 B2 3/2009 Kennewick et al.
7,508,373 B2 3/2009 Lin et al.
7,522,927 B2 4/2009 Fitch et al.
7,523,108 B2 4/2009 Cao
7,526,466 B2 4/2009 Au
7,529,671 B2 5/2009 Rockenbeck et al.
7,529,676 B2 5/2009 Koyama
7,539,656 B2 5/2009 Fratkina et al.
7,546,382 B2 6/2009 Healey et al.
7,548,895 B2 6/2009 Pulsipher
7,555,431 B2 6/2009 Bennett
7,558,730 B2 7/2009 Davis et al.
7,571,106 B2 8/2009 Cao et al.
7,599,918 B2 10/2009 Shen et al.
7,620,549 B2 11/2009 Di Cristo et al.
7,624,007 B2 11/2009 Bennett
7,634,409 B2 12/2009 Kennewick et al.
7,636,657 B2 12/2009 Ju et al.
7,640,160 B2 12/2009 Di Cristo et al.
7,647,225 B2 1/2010 Bennett et al.
7,657,424 B2 2/2010 Bennett
7,672,841 B2 3/2010 Bennett
7,676,026 B1 3/2010 Baxter, Jr.
7,684,985 B2 3/2010 Dominach et al.
7,693,715 B2 4/2010 Hwang et al.
7,693,720 B2 4/2010 Kennewick et al.
7,698,131 B2 4/2010 Bennett
7,702,500 B2 4/2010 Blaedow
7,702,508 B2 4/2010 Bennett
7,707,027 B2 4/2010 Balchandran et al.
7,707,032 B2 4/2010 Wang et al.
7,707,267 B2 4/2010 Lisitsa et al.
7,711,565 B1 5/2010 Gazdzinski
7,711,672 B2 5/2010 Au
7,716,056 B2 5/2010 Weng et al.
7,720,674 B2 5/2010 Kaiser et al.
7,720,683 B1 5/2010 Vermeulen et al.
7,725,307 B2 5/2010 Bennett
7,725,318 B2 5/2010 Gavalda et al.
7,725,320 B2 5/2010 Bennett

(56) References Cited

U.S. PATENT DOCUMENTS 7,725,321 B2 5/2010 Bennett
7,729,904 B2 6/2010 Bennett
7,729,916 B2 6/2010 Coffman et al.
7,734,461 B2 6/2010 Kwak et al.
7,752,152 B2 7/2010 Paek et al.
7,774,204 B2 8/2010 Mozer et al.
7,783,486 B2 8/2010 Rosser et al.
7,801,729 B2 9/2010 Mozer
7,809,570 B2 10/2010 Kennewick et al.
7,809,610 B2 10/2010 Cao
7,818,176 B2 10/2010 Freeman et al.
7,822,608 B2 10/2010 Cross, Jr. et al.
7,826,945 B2 11/2010 Zhang et al.
7,831,426 B2 11/2010 Bennett
7,840,400 B2 11/2010 Lavi et al.
7,840,447 B2 11/2010 Kleinrock et al.
7,873,519 B2 1/2011 Bennett
7,873,654 B2 1/2011 Bernard
7,881,936 B2 2/2011 Longé et al.
7,912,702 B2 3/2011 Bennett
7,917,367 B2 3/2011 Di Cristo et al.
7,917,497 B2 3/2011 Harrison et al.
7,920,678 B2 4/2011 Cooper et al.
7,925,525 B2 4/2011 Chin
7,930,168 B2 4/2011 Weng et al.
7,949,529 B2 5/2011 Weider et al.
7,949,534 B2 5/2011 Davis et al.
7,974,844 B2 7/2011 Sumita
7,974,972 B2 7/2011 Cao
7,983,915 B2 7/2011 Knight et al.
7,983,917 B2 7/2011 Kennewick et al.
7,983,997 B2 7/2011 Allen et al.
7,987,151 B2 7/2011 Schott et al.
8,000,453 B2 8/2011 Cooper et al.
8,005,679 B2 8/2011 Jordan et al.
8,015,006 B2 9/2011 Kennewick et al.
8,024,195 B2 9/2011 Mozer et al.
8,036,901 B2 10/2011 Mozer
8,041,570 B2 10/2011 Mirkovic et al.
8,041,611 B2 10/2011 Kleinrock et al.
8,055,708 B2 11/2011 Chitsaz et al.
8,065,155 B1 11/2011 Gazdzinski
8,065,156 B2 11/2011 Gazdzinski
8,069,046 B2 11/2011 Kennewick et al.
8,073,681 B2 12/2011 Baldwin et al.
8,078,473 B1 12/2011 Gazdzinski
8,082,153 B2 12/2011 Coffman et al.
8,095,364 B2 1/2012 LongÉ et al.
8,099,289 B2 1/2012 Mozer et al.
8,107,401 B2 1/2012 John et al.
8,112,275 B2 2/2012 Kennewick et al.
8,112,280 B2 2/2012 Lu
8,117,037 B2 2/2012 Gazdzinski
8,131,557 B2 3/2012 Davis et al.
8,140,335 B2 3/2012 Kennewick et al.
8,165,886 B1 4/2012 Gagnon et al.
8,166,019 B1 4/2012 Lee et al.
8,190,359 B2 5/2012 Bourne
8,195,467 B2 6/2012 Mozer et al.
8,204,238 B2 6/2012 Mozer
8,205,788 B1 6/2012 Gazdzinski et al.
8,219,407 B1 7/2012 Roy et al.
8,285,551 B2 10/2012 Gazdzinski
8,285,553 B2 10/2012 Gazdzinski
8,290,778 B2 10/2012 Gazdzinski
8,290,781 B2 10/2012 Gazdzinski
8,296,146 B2 10/2012 Gazdzinski
8,296,153 B2 10/2012 Gazdzinski
8,301,456 B2 10/2012 Gazdzinski
8,311,834 B1 11/2012 Gazdzinski
8,370,158 B2 2/2013 Gazdzinski
8,371,503 B2 2/2013 Gazdzinski
8,447,612 B2 5/2013 Gazdzinski
2002/0032564 A1 3/2002 Ehsani et al.
2002/0046025 A1 4/2002 Hain
2002/0069063 A1 6/2002 Buchner et al.
2002/0077817 A1 6/2002 Atal
2002/0099547 A1* 7/2002 Chu et al. ..... 704/260
2003/0154081 A1* 8/2003 Chu et al. ..... 704/266
2004/0073427 A1* 4/2004 Moore ..... 704/258
2004/0135701 A1 7/2004 Yasuda et al.
2005/0060155 A1* 3/2005 Chu et al. ..... 704/269
2005/0071332 A1 3/2005 Ortega et al.
2005/0080625 A1 4/2005 Bennett et al.
2005/0119890 A1* 6/2005 Hirose ..... 704/260
2005/0119897 A1 6/2005 Bennett et al.
2005/0143972 A1 6/2005 Gopalakrishnan et al.
2005/0182629 A1 8/2005 Coorman et al.
2005/0196733 A1 9/2005 Budra et al.
2006/0018492 A1 1/2006 Chiu et al.
2006/0122834 A1 6/2006 Bennett
2006/0136213 A1* 6/2006 Hirose et al. ..... 704/260
2006/0143007 A1 6/2006 Koh et al.
2007/0055529 A1 3/2007 Kanevsky et al.
2007/0058832 A1 3/2007 Hug et al.
2007/0088556 A1 4/2007 Andrew
2007/0100790 A1 5/2007 Cheyer et al.
2007/0118377 A1 5/2007 Badino et al.
2007/0174188 A1 7/2007 Fish
2007/0185917 A1 8/2007 Prahlad et al.
2007/0282595 A1 12/2007 Tunning et al.
2008/0015864 A1 1/2008 Ross et al.
2008/0021708 A1 1/2008 Bennett et al.
2008/0034032 A1 2/2008 Healey et al.
2008/0052063 A1 2/2008 Bennett et al.
2008/0059190 A1* 3/2008 Chu et al. ..... 704/258
2008/0120112 A1 5/2008 Jordan et al.
2008/0129520 A1 6/2008 Lee
2008/0140657 A1 6/2008 Azvine et al.
2008/0221903 A1 9/2008 Kanevsky et al.
2008/0228496 A1 9/2008 Yu et al.
2008/0247519 A1 10/2008 Abella et al.
2008/0249770 A1 10/2008 Kim et al.
2008/0300878 A1 12/2008 Bennett
2008/0306727 A1* 12/2008 Thurmair et al. ..... 704/4
2009/0006100 A1 1/2009 Badger et al.
2009/0006343 A1 1/2009 Platt et al.
2009/0030800 A1 1/2009 Grois
2009/0058823 A1 3/2009 Kocienda
2009/0076796 A1 3/2009 Daraselia
2009/0089058 A1 4/2009 Bellegarda
2009/0100049 A1 4/2009 Cao
2009/0112677 A1 4/2009 Rhett
2009/0150156 A1 6/2009 Kennewick et al.
2009/0157401 A1 6/2009 Bennett
2009/0164441 A1 6/2009 Cheyer
2009/0171664 A1 7/2009 Kennewick et al.
2009/0290718 A1 11/2009 Kahn et al.
2009/0299745 A1 12/2009 Kennewick et al.
2009/0299849 A1 12/2009 Cao et al.
2010/0005081 A1 1/2010 Bennett
2010/0023320 A1 1/2010 Di Cristo et al.
2010/0036660 A1 2/2010 Bennett
2010/0042400 A1 2/2010 Block et al.
2010/0088020 A1 4/2010 Sano et al.
2010/0145700 A1 6/2010 Kennewick et al.
2010/0204986 A1 8/2010 Kennewick et al.
2010/0217604 A1 8/2010 Baldwin et al.
2010/0228540 A1 9/2010 Bennett
2010/0235341 A1 9/2010 Bennett
2010/0257160 A1 10/2010 Cao
2010/0277579 A1 11/2010 Cho et al.
2010/0280983 A1 11/2010 Cho et al.
2010/0286985 A1 11/2010 Kennewick et al.
2010/0299142 A1 11/2010 Freeman et al.
2010/0312547 A1 12/2010 van Os et al.
2010/0318576 A1 12/2010 Kim
2010/0332235 A1 12/2010 David
2010/0332348 A1 12/2010 Cao
2011/0060807 A1 3/2011 Martin et al.
2011/0082688 A1 4/2011 Kim et al.
2011/0112827 A1 5/2011 Kennewick et al.
2011/0112921 A1 5/2011 Kennewick et al.
2011/0119049 A1 5/2011 Ylonen

(56) References Cited

U.S. PATENT DOCUMENTS

| | | | |
|---|---|---|---|
| 2011/0125540 | A1 | 5/2011 | Jang et al. |
| 2011/0130958 | A1 | 6/2011 | Stahl et al. |
| 2011/0131036 | A1 | 6/2011 | Di Cristo et al. |
| 2011/0131045 | A1 | 6/2011 | Cristo et al. |
| 2011/0144999 | A1 | 6/2011 | Jang et al. |
| 2011/0161076 | A1 | 6/2011 | Davis et al. |
| 2011/0175810 | A1 | 7/2011 | Markovic et al. |
| 2011/0184730 | A1 | 7/2011 | LeBeau et al. |
| 2011/0218855 | A1 | 9/2011 | Cao et al. |
| 2011/0231182 | A1 | 9/2011 | Weider et al. |
| 2011/0231188 | A1 | 9/2011 | Kennewick et al. |
| 2011/0264643 | A1 | 10/2011 | Cao |
| 2011/0279368 | A1 | 11/2011 | Klein et al. |
| 2011/0306426 | A1 | 12/2011 | Novak et al. |
| 2012/0002820 | A1 | 1/2012 | Leichter |
| 2012/0016678 | A1 | 1/2012 | Gruber et al. |
| 2012/0020490 | A1 | 1/2012 | Leichter |
| 2012/0022787 | A1 | 1/2012 | LeBeau et al. |
| 2012/0022857 | A1 | 1/2012 | Baldwin et al. |
| 2012/0022860 | A1 | 1/2012 | Lloyd et al. |
| 2012/0022868 | A1 | 1/2012 | LeBeau et al. |
| 2012/0022869 | A1 | 1/2012 | Lloyd et al. |
| 2012/0022870 | A1 | 1/2012 | Kristjansson et al. |
| 2012/0022874 | A1 | 1/2012 | Lloyd et al. |
| 2012/0022876 | A1 | 1/2012 | LeBeau et al. |
| 2012/0023088 | A1 | 1/2012 | Cheng et al. |
| 2012/0034904 | A1 | 2/2012 | LeBeau et al. |
| 2012/0035908 | A1 | 2/2012 | LeBeau et al. |
| 2012/0035924 | A1 | 2/2012 | Jitkoff et al. |
| 2012/0035931 | A1 | 2/2012 | LeBeau et al. |
| 2012/0035932 | A1 | 2/2012 | Jitkoff et al. |
| 2012/0042343 | A1 | 2/2012 | Laligand et al. |
| 2012/0271676 | A1 | 10/2012 | Aravamudan et al. |
| 2012/0311583 | A1 | 12/2012 | Gruber et al. |

FOREIGN PATENT DOCUMENTS

| | | | |
|---|---|---|---|
| EP | 0138061 | B1 | 9/1984 |
| EP | 0138061 | A1 | 4/1985 |
| EP | 0218859 | A2 | 4/1987 |
| EP | 0262938 | A1 | 4/1988 |
| EP | 0293259 | A2 | 11/1988 |
| EP | 0299572 | A2 | 1/1989 |
| EP | 0313975 | A2 | 5/1989 |
| EP | 0314908 | A2 | 5/1989 |
| EP | 0327408 | A2 | 8/1989 |
| EP | 0389271 | A2 | 9/1990 |
| EP | 0411675 | A2 | 2/1991 |
| EP | 0559349 | A1 | 9/1993 |
| EP | 0559349 | B1 | 9/1993 |
| EP | 0570660 | A1 | 11/1993 |
| EP | 1245023 | A1 | 10/2002 |
| JP | 06 019965 | | 1/1994 |
| JP | 2001 125896 | | 5/2001 |
| JP | 2002 024212 | | 1/2002 |
| JP | 2003517158 | A | 5/2003 |
| JP | 2009 036999 | | 2/2009 |
| KR | 10-0776800 | B1 | 11/2007 |
| KR | 10-0810500 | B1 | 3/2008 |
| KR | 10 2008 109322 | A | 12/2008 |
| KR | 10 2009 086805 | A | 8/2009 |
| KR | 10-0920267 | B1 | 10/2009 |
| KR | 10 2011 0113414 | A | 10/2011 |
| WO | WO 2006/129967 | A1 | 12/2006 |
| WO | WO 2011/088053 | A2 | 7/2011 |

OTHER PUBLICATIONS

Klabbers, Esther, et al., "Reducing Audible Spectral Discontinuties", IEEE Transactions on Speech and Audio Processing, vol. 9, No. 1, Jan. 2001. 1063-6676/01 $10.00 Copyright 2001 IEEE. pp. 39-51.

Bellegarda, "Latent Semantic Mapping" IEEE Signal Processing Magazine, 22(5):70-80, 2005.

Bellegarda, Jerome R. "Latent Semantic Mapping" IEEE Signal Processing Magazine, Sep. 2005 1053-5888/05 Copyright 2005 IEEE, pp. 2-13.

Biemann, Chris, "Unsupervised part-of-speech tagging employing efficient graph clustering" in Proceedings of the COLING/ACL 2006 Student Research Workshop, pp. 7-12, 2006.

Lafferty, John, et al., "Conditional Random Fields: Probabilistic Models for Segmenting and Labeling Sequence Data", WhizBang! Labs-Research, Pittsburgh, PA, School of Computer Science, Carnegie Mellon University, Pittsburgh, PA, Dept. of Computer and Information Science, University of Pennsylvania, Philadelphia, PA. 8 pages.

Marcus, Mitchell P., et al., "Building a Large Annotated Corpus of English: The Penn Treebank", Copyright 1993 Association for Computational Linguistics, vol. 19, No. 2, 18 pages.

Sarawagi, S. "CRF Package for Java," http://crf.sourceforge.net, 2004, downloaded Apr. 6, 2011.

Schmid, H., Part-of-speech tagging with neural networks in Proceedings COLING, Kyoto, Japan, pp. 172-176, 1994.

Schutze, Hinrich, "Distributional part-of-speech tagging" in EACL-95, 9 pages, 1995.

Schutze, Hinrich, Part-of-speech induction from scratch. In 31st Annual Meeting of the Association for Computational Linguistics, pp. 251-258, 1993.

Toutanova, Kristina, et al., "Feature-Rich Part-of-Speech Tagging with a Cyclic Dependency Network", 8 pages. Computer Science Dept., Stanford University, Stanford CA 94305-9040.

Chen, Y., "Multimedia Siri Finds and Plays Whatever You Ask for," Feb. 9, 2012, http://www.psfk.com/2012/02/multimedia-siri.html, 9 pages.

Cheyer, A. et al., "Spoken Language and Multimodal Applications for Electronic Realties," © Springer-Verlag London Ltd, Virtual Reality 1999, 3:1-15, 15 pages.

Cutkosky, M. R. et al., "PACT: An Experiment in Integrating Concurrent Engineering Systems," Journal, Computer, vol. 26 Issue 1, Jan. 1993, IEEE Computer Society Press Los Alamitos, CA, USA, http://dl.acm.org/citation.cfm?id=165320, 14 pages.

Elio, R. et al., "On Abstract Task Models and Conversation Policies," http://webdocs.cs.ualberta.ca/~ree/publications/papers2/ATS.AA99.pdf, 10 pages.

Ericsson, S. et al., "Software illustrating a unified approach to multimodality and multilinguality in the in-home domain," Dec. 22, 2006, Talk and Look: Tools for Ambient Linguistic Knowledge, http://www.talk-project.eurice.eu/fileadmin/talk/publications_public/deliverables_public/D1_6.pdf, 127 pages.

Evi, "Meet Evi: the one mobile app that provides solutions for your everyday problems," Feb. 8, 2012, http://www.evi.com/, 3 pages.

Feigenbaum, E., et al., "Computer-assisted Semantic Annotation of Scientific Life Works," 2007, http://tomgruber.org/writing/stanford-cs300.pdf, 22 pages.

Gannes, L., "Alfred App Gives Personalized Restaurant Recommendations," allthingsd.com, Jul. 18, 2011, http://allthingsd.com/20110718/alfred-app-gives-personalized-restaurant-recommendations/, 3 pages.

Gautier, P. O., et al. "Generating Explanations of Device Behavior Using Compositional Modeling and Causal Ordering," 1993, http://citeseerx.ist.psu.edu/viewdoc/surnmary?doi=10.1.1.42.8394, 9 pages.

Gervasio, M. T., et al., Active Preference Learning for Personalized Calendar Scheduling Assistancae, Copyright © 2005, http://www.ai.sri.com/~gervasio/pubs/gervasio-iui05.pdf, 8 pages.

Glass, A., "Explaining Preference Learning," 2006, http://cs229.stanford.edu/proj2006/Glass-ExplainingPreferenceLearning.pdf, 5 pages.

Gruber, T. R., et al., "An Ontology for Engineering Mathematics," in Jon Doyle, Piero Torasso, & Erik Sandewall, Eds., Fourth International Conference on Principles of Knowledge Representation and Reasoning, Gustav Stresemann Institut, Bonn, Germany, Morgan Kaufmann, 1994, http://www-ksl.stanford.edu/knowledge-sharing/papers/engmath.html, 22 pages.

(56) References Cited

OTHER PUBLICATIONS

Gruber, T. R., "A Translation Approach to Portable Ontology Specifications," Knowledge Systems Laboratory, Stanford University, Sep. 1992, Technical Report KSL 92-71, Revised Apr. 1993, 27 pages.
Gruber, T. R., "Automated Knowledge Acquisition for Strategic Knowledge," Knowledge Systems Laboratory, Machine Learning, 4, 293-336 (1989), 44 pages.
Gruber, T. R., "(Avoiding) the Travesty of the Commons," Presentation at NPUC 2006, New Paradigms for User Computing, IBM Almaden Research Center, Jul. 24, 2006. http://tomgruber.org/writing/avoiding-travestry.htm, 52 pages.
Glass, J., et al., "Multilingual Spoken-Language Understanding in the MIT Voyager System," Aug. 1995, http://groups.csail.mit.edu/sls/publications/1995/speechcomnn95-voyager.pdf, 29 pages.
Goddeau, D., et al., "A Form-Based Dialogue Manager for Spoken Language Applications," Oct. 1996, http://phasedance.com/pdf/icslp96.pdf, 4 pages.
Goddeau, D., et al., "Galaxy: A Human-Language Interface to On-Line Travel Information," 1994 International Conference on Spoken Language Processing, Sep. 18-22, 1994, Pacific Convention Plaza Yokohama, Japan, 6 pages.
Meng, H., et al., "Wheels: A Conversational System in the Automobile Classified Domain," Oct. 1996, httphttp://citeseerx.ist.psu.edu/viewdoc/summary?doi=10.1.1.16.3022, 4 pages.
*Phoenix Solutions, Inc.* v. *West Interactive Corp.*, Document 40, Declaration of Christopher Schmandt Regarding the MIT Galaxy System dated Jul. 2, 2010, 162 pages.
Seneff, S., et al., "A New Restaurant Guide Conversational System: Issues in Rapid Prototyping for Specialized Domains," Oct. 1996, citeseerx.ist.psu.edu/viewdoc/download?doi=10.1.1.16 . . . rep . . ., 4 pages.
Vlingo InCar, "Distracted Driving Solution with Vlingo InCar," 2:38 minute video uploaded to YouTube by Vlingo Voice on Oct. 6, 2010, http://www.youtube.com/watch?v=Vqs8XfXxgz4, 2 pages.
Zue, V., "Conversational Interfaces: Advances and Challenges," Sep. 1997, http://www.cs.cmu.edu/~dod/papers/zue97.pdf, 10 pages.
Zue, V. W., "Toward Systems that Understand Spoken Language," Feb. 1994, ARPA Strategic Computing Institute, ©1994 IEEE, 9 pages.
Alfred App, 2011, http://www.alfredapp.com/, 5 pages.
Ambite, JL., et al., "Design and Implementation of the CALO Query Manager," Copyright @ 2006, American Association for Artificial Intelligence, (www.aaai.org), 8 pages.
Ambite, JL., et al., "Integration of Heterogeneous Knowledge Sources in the CALO Query Manager," 2005, The 4th International Conference on Ontologies, DataBases, and Applications of Semantics (ODBASE), Agia Napa, Cyprus, ttp://www.isi.edu/people/ambite/publications/integration_heterogeneous_knowledge_sources_calo_query_manager, 18 pages.
Belvin, R. et al., "Development of the HRL Route Navigation Dialogue System," 2001, In Proceedings of the First International Conference on Human Language Technology Research, Paper, Copyright © 2001 HRL Laboratories, LLC, http://citeseerx.ist.psu.edu/viewdoc/summary?doi=10.1.1.10.6538, 5 pages.
Berry, P. M., et al. "PTIME: Personalized Assistance for Calendaring," ACM Transactions on Intelligent Systems and Technology, vol. 2, No. 4, Article 40, Publication date: Jul. 2011, 40:1-22, 22 pages.
Butcher, M., "EVI arrives in town to go toe-to-toe with Siri," Jan. 23, 2012, http://techcrunch.com/2012/01/23/evi-arrives-in-town-to-go-toe-to-toe-with-siri/, 2 pages.
Gruber, T. R., "Big Think Small Screen: How semantic computing in the cloud will revolutionize the consumer experience on the phone," Keynote presentation at Web 3.0 conference, Jan. 27, 2010, http://tomgruber.org/writing/web30jan2010.htm, 41 pages.
Gruber, T. R., "Collaborating around Shared Content on the WWW," W3C Workshop on WWW and Collaboration, Cambridge, MA, Sep. 11, 1995, http://www.w3.org/Collaboration/Workshop/Proceedings/P9.html, 1 page.
Gruber, T. R., "Collective Knowledge Systems: Where the Social Web meets the Semantic Web," Web Semantics: Science, Services and Agents on the World Wide Web (2007), doi:10.1016/j.websem.2007.11.011, keynote presentation given at the 5th International Semantic Web Conference, Nov. 7, 2006, 19 pages.
Gruber, T. R., "Where the Social Web meets the Semantic Web," Presentation at the 5th International Semantic Web Conference, Nov. 7, 2006, 38 pages.
Gruber, T. R., "Despite our Best Efforts, Ontologies are not the Problem," AAAI Spring Symposium, Mar. 2008, http://tomgruber.org/writing/aaai-ss08.htm, 40 pages.
Gruber, T. R., "Enterprise Collaboration Management with Intraspect," Intraspect Software, Inc., Instraspect Technical White Paper Jul. 2001, 24 pages.
Gruber, T. R., "Every ontology is a treaty—a social agreement—among people with some common motive in sharing," Interview by Dr. Miltiadis D. Lytras, Official Quarterly Bulletin of AIS Special Interest Group on Semantic Web and Information Systems, vol. 1, Issue 3, 2004, http://www.sigsemis.org 1, 5 pages.
Gruber, T. R., et al., "Generative Design Rationale: Beyond the Record and Replay Paradigm," Knowledge Systems Laboratory, Stanford University, Dec. 1991, Technical Report KSL 92-59, Updated Feb. 1993, 24 pages.
Gruber, T. R., "Helping Organizations Collaborate, Communicate, and Learn," Presentation to NASA Ames Research, Mountain View, CA, Mar. 2003, http://tomgruber.org/writing/organizational-intelligence-talk.htm, 30 pages.
Gruber, T. R., "Intelligence at the Interface: Semantic Technology and the Consumer Internet Experience," Presentation at Semantic Technologies conference (SemTech08), May 20, 2008, http://tomgruber.org/writing.htm, 40 pages.
Gruber, T. R., Interactive Acquisition of Justifications: Learning "Why" by Being Told "What" Knowledge Systems Laboratory, Stanford University, Oct. 1990, Technical Report KSL 91-17, Revised Feb. 1991, 24 pages.
Gruber, T. R., "It Is What It Does: The Pragmatics of Ontology for Knowledge Sharing," (c) 2000, 2003, http://www.cidoc-crm.org/docs/symposium_presentations/gruber_cidoc-ontology-2003.pdf, 21 pages.
Gruber, T. R., et al., "Machine-generated Explanations of Engineering Models: A Compositional Modeling Approach," (1993) In Proc. International Joint Conference on Artificial Intelligence, http://citeseerx.ist.psu.edu/viewdoc/summary?doi=10.1.1.34.930, 7 pages.
Gruber, T. R., "2021: Mass Collaboration and the Really New Economy," TNTY Futures, the newsletter of The Next Twenty Years series, vol. 1, Issue 6, Aug. 2001, http://www.tnty.com/newsletter/futures/archive/v01-05business.html, 5 pages.
Gruber, T. R., et al.,"NIKE: A National Infrastructure for Knowledge Exchange," Oct. 1994, http://www.eit.com/papers/nike/nike.html and nike.ps, 10 pages.
Gruber, T. R., "Ontologies, Web 2.0 and Beyond," Apr. 24, 2007, Ontology Summit 2007, http://tomgruber.org/writing/ontolog-social-web-keynote.pdf, 17 pages.
Gruber, T. R., "Ontology of Folksonomy: A Mash-up of Apples and Oranges," Originally published to the web in 2005, Int'l Journal on Semantic Web & Information Systems, 3(2), 2007, 7 pages.
Gruber, T. R., "Siri, a Virtual Personal Assistant—Bringing Intelligence to the Interface," Jun. 16, 2009, Keynote presentation at Semantic Technologies conference, Jun. 2009. http://tomgruber.org/writing/semtech09.htm, 22 pages.
Gruber, T. R., "TagOntology," Presentation to Tag Camp, www.tagcamp.org, Oct. 29, 2005, 20 pages.
Gruber, T. R., et al., "Toward a Knowledge Medium for Collaborative Product Development," in Artificial Intelligence in Design 1992, from Proceedings of the Second International Conference on Artificial Intelligence in Design, Pittsburgh, USA, Jun. 22-25, 1992, 19 pages.
Gruber, T. R., "Toward Principles for the Design of Ontologies Used for Knowledge Sharing," In International Journal Human-Computer Studies 43, p. 907-928, substantial revision of paper presented at the International Workshop on Formal Ontology, Mar. 1993, Padova,

(56) References Cited

OTHER PUBLICATIONS

Italy, available as Technical Report KSL 93-04, Knowledge Systems Laboratory, Stanford University, further revised Aug. 23, 1993, 23 pages.
Guzzoni, D., et al., "Active, A Platform for Building Intelligent Operating Rooms," Surgetica 2007 Computer-Aided Medical Interventions: tools and applications, pp. 191-198, Paris, 2007, Sauramps Médical, http://lsro.epfl.ch/page-68384-en.html, 8 pages.
Guzzoni, D., et al., "Active, A Tool for Building Intelligent User Interfaces," ASC 2007, Palma de Mallorca, http://lsro.epfl.ch/page-34241.html, 6 pages.
Guzzoni, D., et al., "Modeling Human-Agent Interaction with Active Ontologies," 2007, AAAI Spring Symposium, Interaction Challenges for Intelligent Assistants, Stanford University, Palo Alto, California, 8 pages.
Hardawar, D., "Driving app Waze builds its own Siri for hands-free voice control," Feb. 9, 2012, http://venturebeat.com/2012/02/09/driving-app-waze-builds-its-own-siri-for-hands-free-voice-control/, 4 pages.
Intraspect Software, "The Intraspect Knowledge Management Solution: Technical Overview," http://tomgruber.org/writing/intraspect-whitepaper-1998.pdf, 18 pages.
Julia, L., et al., Un éditeur interactif de tableaux dessinés à main levée (An Interactive Editor for Hand-Sketched Tables), Traitement du Signal 1995, vol. 12, No. 6, 8 pages.
Karp, P. D., "A Generic Knowledge-Base Access Protocol," May 12, 1994, http://lecture.cs.buu.ac.th/~f50353/Document/gfp.pdf, 66 pages.
Lemon, O., et al., "Multithreaded Context for Robust Conversational Interfaces: Context-Sensitive Speech Recognition and Interpretation of Corrective Fragments," Sep. 2004, ACM Transactions on Computer-Human Interaction, vol. 11, No. 3, 27 pages.
Leong, L., et al., "CASIS: A Context-Aware Speech Interface System," IUI'05, Jan. 9-12, 2005, Proceedings of the 10th international conference on Intelligent user interfaces, San Diego, California, USA, 8 pages.
Lieberman, H., et al., "Out of context: Computer systems that adapt to, and learn from, context," 2000, IBM Systems Journal, vol. 39, Nos. 3/4, 2000, 16 pages.
Lin, B., et al., "A Distributed Architecture for Cooperative Spoken Dialogue Agents with Coherent Dialogue State and History," 1999, http://citeseerx.ist.psu.edu/viewdoc/summary?doi=10.1.1.42.272, 4 pages.
McGuire, J., et al., "SHADE: Technology for Knowledge-Based Collaborative Engineering," 1993, Journal of Concurrent Engineering: Applications and Research (CERA), 18 pages.
Milward, D., et al., "D2.2: Dynamic Multimodal Interface Reconfiguration," Talk and Look: Tools for Ambient Linguistic Knowledge, Aug. 8, 2006, http://www.ihmc.us/users/nblaylock/Pubs/Files/talk_d2.2.pdf, 69 pages.
Mitra, P., et al., "A Graph-Oriented Model for Articulation of Ontology Interdependencies," 2000, http://ilpubs.stanford.edu:8090/442/1/2000-20.pdf, 15 pages.
Moran, D. B., et al., "Multimodal User Interfaces in the Open Agent Architecture," Proc. of the 1997 International Conference on Intelligent User Interfaces (IUI97), 8 pages.
Mozer, M., "An Intelligent Environment Must be Adaptive," Mar./Apr. 1999, IEEE Intelligent Systems, 3 pages.
Mühlhäuser, M., "Context Aware Voice User Interfaces for Workflow Support," Darmstadt 2007, http://tuprints.ulb.tu-darmstadt.de/876/1/PhD.pdf, 254 pages.
Naone, E., "TR10: Intelligent Software Assistant," Mar.-Apr. 2009, Technology Review, http://www.technologyreview.com/printer_friendly_article.aspx?id=22117, 2 pages.
Neches, R., "Enabling Technology for Knowledge Sharing," Fall 1991, AI Magazine, pp. 37-56, (21 pages).
Nöth, E., et al., "Verbmobil: The Use of Prosody in the Linguistic Components of a Speech Understanding System," IEEE Transactions on Speech and Audio Processing, vol. 8, No. 5, Sep. 2000, 14 pages.
Rice, J., et al., "Monthly Program: Nov. 14, 1995," The San Francisco Bay Area Chapter of ACM SIGCHI, http://www.baychi.org/calendar/19951114/, 2 pages.
Rice, J., et al., "Using the Web Instead of a Window System," Knowledge Systems Laboratory, Stanford University, http://tomgruber.org/writing/ksl-95-69.pdf, 14 pages.
Rivlin, Z., et al., "Maestro: Conductor of Multimedia Analysis Technologies," 1999 SRI International, Communications of the Association for Computing Machinery (CACM), 7 pages.
Sheth, A., et al., "Relationships at the Heart of Semantic Web: Modeling, Discovering, and Exploiting Complex Semantic Relationships," Oct. 13, 2002, Enhancing the Power of the Internet: Studies in Fuzziness and Soft Computing, SpringerVerlag, 38 pages.
Simonite, T., "One Easy Way to Make Siri Smarter," Oct. 18, 2011, Technology Review, http://www.technologyreview.com/printer_friendly_article.aspx?id=38915, 2 pages.
Stent, A., et al., "The CommandTalk Spoken Dialogue System," 1999, http://acl.ldc.upenn.edu/P/P99/P99-1024.pdf, 8 pages.
Tofel, K., et al., "SpeakTolt: A personal assistant for older iPhones, iPads," Feb. 9, 2012, http://gigaom.com/apple/speaktoit-siri-for-older-iphones-ipads/, 7 pages.
Tucker, J., "Too lazy to grab your TV remote? Use Siri instead," Nov. 30, 2011, http://www.engadget.com/2011/11/30/too-lazy-to-grab-your-tv-remote-use-siri-instead/, 8 pages.
Tur, G., et al., "The CALO Meeting Speech Recognition and Understanding System," 2008, Proc. IEEE Spoken Language Technology Workshop, 4 pages.
Tur, G., et al., "The-CALO-Meeting-Assistant System," IEEE Transactions on Audio, Speech, and Language Processing, vol. 18, No. 6, Aug. 2010, 11 pages.
Vlingo, "Vlingo Launches Voice Enablement Application on Apple App Store," Vlingo press release dated Dec. 3, 2008, 2 pages.
YouTube, "Knowledge Navigator," 5:34 minute video uploaded to YouTube by Knownav on Apr. 29, 2008, http://www.youtube.com/watch?v=QRH8eimU_20on Aug. 3, 2006, 1 page.
YouTube,"Send Text, Listen To and Send E-Mail 'By Voice' www.voiceassist.com," 2:11 minute video uploaded to YouTube by VoiceAssist on Jul 30, 2009, http://www.youtube.com/watch?v=0tEU61nHHA4, 1 page.
YouTube,"Text'nDrive App Demo—Listen and Reply to your Messages by Voice while Driving!," 1:57 minute video uploaded to YouTube by TextnDrive on Apr 27, 2010, http://www.youtube.com/watch?v=WaGfzoHsAMw, 1 page.
YouTube, "Voice on the Go (BlackBerry)," 2:51 minute video uploaded to YouTube by VoiceOnTheGo on Jul. 27, 2009, http://www.youtube.com/watch?v=pJqpWgQS98w, 1 page.
International Search Report and Written Opinion dated Nov. 29, 2011, received in International Application No. PCT/US2011/20861, which corresponds to U.S. Appl. No. 12/987,982, 15 pages (Thomas Robert Gruber).
Martin, D., et al, "The Open Agent Architecture: A Framework for building distributed software systems," Jan.-Mar. 1999, Applied Artificial Intelligence: An International Journal, vol. 13, No. 1-2, http://adam.cheyer.com/papers/oaa.pdf, 38 pages.
Bussler, C., et al., "Web Service Execution Environment (WSMX)," Jun. 3, 2005, W3C Member Submission, http://www.w3.org/Submission/WSMX, 29 pages.
Cheyer, A., "About Adam Cheyer," Sep. 17, 2012, http://www.adam.cheyer.com/about.html, 2 pages.
Cheyer, A., "A Perspective on AI & Agent Technologies for SCM," VerticalNet, 2001 presentation, 22 pages.
Domingue, J., et al., "Web Service Modeling Ontology (WSMO)—An Ontology for Semantic Web Services," Jun. 9-10, 2005, position paper at the W3C Workshop on Frameworks for Semantics in Web Services, Innsbruck, Austria, 6 pages.
Guzzoni, D., et al., "A Unified Platform for Building Intelligent Web Interaction Assistants," Proceedings of the 2006 IEEE/WIC/ACM International Conference on Web Intelligence and Intelligent Agent Technology, Computer Society, 4 pages.
Roddy, D., et al., "Communication and Collaboration in a Landscape of B2B eMarketplaces," VerticalNet Solutions, white paper, Jun. 15, 2000, 23 pages.

(56) References Cited

OTHER PUBLICATIONS

Acero, A., et al., "Environmental Robustness in Automatic Speech Recognition," International Conference on Acoustics, Speech, and Signal Processing (ICASSP'90), Apr. 3-6, 1990, 4 pages.
Acero, A., et al., "Robust Speech Recognition by Normalization of the Acoustic Space," International Conference on Acoustics, Speech, and Signal Processing, 1991, 4 pages.
Ahlbom, G., et al., "Modeling Spectral Speech Transitions Using Temporal Decomposition Techniques," IEEE International Conference of Acoustics, Speech, and Signal Processing (ICASSP'87), Apr. 1987, vol. 12, 4 pages.
Aikawa, K., "Speech Recognition Using Time-Warping Neural Networks," Proceedings of the 1991 IEEE Workshop on Neural Networks for Signal Processing, Sep. 30 to Oct. 1, 1991, 10 pages.
Anastasakos, A., et al., "Duration Modeling in Large Vocabulary Speech Recognition," International Conference on Acoustics, Speech, and Signal Processing (ICASSP'95), May 9-12, 1995, 4 pages.
Anderson, R. H., "Syntax-Directed Recognition of Hand-Printed Two-Dimensional Mathematics," In Proceedings of Symposium on Interactive Systems for Experimental Applied Mathematics: Proceedings of the Association for Computing Machinery Inc. Symposium, ©1967, 12 pages.
Ansari, R., et al., "Pitch Modification of Speech using a Low-Sensitivity Inverse Filter Approach," IEEE Signal Processing Letters, vol. 5, No. 3, Mar. 1998, 3 pages.
Anthony, N. J., et al., "Supervised Adaption for Signature Verification System," Jun. 1, 1978, IBM Technical Disclosure, 3 pages.
Apple Computer, "Guide Maker User's Guide," © Apple Computer, Inc., Apr. 27, 1994, 8 pages.
Apple Computer, "Introduction to Apple Guide," © Apple Computer, Inc., Apr. 28, 1994, 20 pages.
Asanović, K., et al., "Experimental Determination of Precision Requirements for Back-Propagation Training of Artificial Neural Networks," In Proceedings of the 2nd International Conference of Microelectronics for Neural Networks, 1991, www.ICSI.Berkeley.EDU, 7 pages.
Atal, B. S., "Efficient Coding of LPC Parameters by Temporal Decomposition," IEEE International Conference on Acoustics, Speech, and Signal Processing (ICASSP'83), Apr. 1983, 4 pages.
Bahl, L. R., et al., "Acoustic Markov Models Used in the Tangora Speech Recognition System," In Proceeding of International Conference on Acoustics, Speech, and Signal Processing (ICASSP'88), Apr. 11-14, 1988, vol. 1, 4 pages.
Bahl, L. R., et al., "A Maximum Likelihood Approach to Continuous Speech Recognition," IEEE Transaction on Pattern Analysis and Machine Intelligence, vol. PAMI-5, No. 2, Mar. 1983, 13 pages.
Bahl, L. R., et al., "A Tree-Based Statistical Language Model for Natural Language Speech Recognition," IEEE Transactions on Acoustics, Speech and Signal Processing, vol. 37, Issue 7, Jul. 1989, 8 pages.
Bahl, L. R., et al., "Large Vocabulary Natural Language Continuous Speech Recognition," In Proceedings of 1989 International Conference on Acoustics, Speech, and Signal Processing, May 23-26, 1989, vol. 1, 6 pages.
Bahl, L. R., et al, "Multonic Markov Word Models for Large Vocabulary Continuous Speech Recognition," IEEE Transactions on Speech and Audio Processing, vol. 1, No. 3, Jul. 1993, 11 pages.
Bahl, L. R., et al., "Speech Recognition with Continuous-Parameter Hidden Markov Models," In Proceeding of International Conference on Acoustics, Speech, and Signal Processing (ICASSP'88), Apr. 11-14, 1988, vol. 1, 8 pages.
Banbrook, M., "Nonlinear Analysis of Speech from a Synthesis Perspective," A thesis submitted for the degree of Doctor of Philosophy, The University of Edinburgh, Oct. 15, 1996, 35 pages.
Belaid, A., et al., "A Syntactic Approach for Handwritten Mathematical Formula Recognition," IEEE Transactions on Pattern Analysis and Machine Intelligence, vol. PAMI-6, No. 1, Jan. 1984, 7 pages.
Bellegarda, E. J., et al., "On-Line Handwriting Recognition Using Statistical Mixtures," Advances in Handwriting and Drawings: A Multidisciplinary Approach, Europia, 6th International IGS Conference on Handwriting and Drawing, Paris- France, Jul. 1993, 11 pages.
Bellegarda, J. R., "A Latent Semantic Analysis Framework for Large-Span Language Modeling," 5th European Conference on Speech, Communication and Technology, (EUROSPEECH'97), Sep. 22-25, 1997, 4 pages.
Bellegarda, J. R., "A Multispan Language Modeling Framework for Large Vocabulary Speech Recognition," IEEE Transactions on Speech and Audio Processing, vol. 6, No. 5, Sep. 1998, 12 pages.
Bellegarda, J. R., et al., "A Novel Word Clustering Algorithm Based on Latent Semantic Analysis," In Proceedings of the IEEE International Conference on Acoustics, Speech, and Signal Processing (ICASSP'96), vol. 1, 4 pages.
Bellegarda, J. R., et al., "Experiments Using Data Augmentation for Speaker Adaptation," International Conference on Acoustics, Speech, and Signal Processing (ICASSP'95), May 9-12, 1995, 4 pages.
Bellegarda, J. R., "Exploiting Both Local and Global Constraints for Multi-Span Statistical Language Modeling," Proceeding of the 1998 IEEE International Conference on Acoustics, Speech, and Signal Processing (ICASSP'98), vol. 2, May 12-15 1998, 5 pages.
Bellegarda, J. R., "Exploiting Latent Semantic Information in Statistical Language Modeling," In Proceedings of the IEEE, Aug. 2000, vol. 88, No. 8, 18 pages.
Bellegarda, J. R., "Interaction-Driven Speech Input—A Data-Driven Approach to the Capture of Both Local and Global Language Constraints," 1992, 7 pages, available at http://old.sigchi.org/bulletin/1998.2/bellegarda.html.
Bellegarda, J. R., "Large Vocabulary Speech Recognition with Multispan Statistical Language Models," IEEE Transactions on Speech and Audio Processing, vol. 8, No. 1, Jan. 2000, 9 pages.
Bellegarda, J. R., et al., "Performance of the IBM Large Vocabulary Continuous Speech Recognition System on the ARPA Wall Street Journal Task," SIGNAL PROCESSING VII: Theories and Applications, © 1994 European Association for Signal Processing, 4 pages.
Bellegarda, J. R., et al., "The Metamorphic Algorithm: A Speaker Mapping Approach to Data Augmentation," IEEE Transactions on Speech and Audio Processing, vol. 2, No. 3, Jul. 1994, 8 pages.
Black, A. W., et al., "Automatically Clustering Similar Units for Unit Selection in Speech Synthesis," In Proceedings of Eurospeech 1997, vol. 2, 4 pages.
Blair, D. C., et al., "An Evaluation of Retrieval Effectiveness for a Full-Text Document-Retrieval System," Communications of the ACM, vol. 28, No. 3, Mar. 1985, 11 pages.
Briner, L. L., "Identifying Keywords in Text Data Processing," in Zelkowitz, Marvin V., ED, Directions and Challenges, 15th Annual Technical Symposium, Jun. 17, 1976, Gaithersbury, Maryland, 7 pages.
Bulyko, I., et al., "Joint Prosody Prediction and Unit Selection for Concatenative Speech Synthesis," Electrical Engineering Department, University of Washington, Seattle, 2001, 4 pages.
Bussey, H. E., et al., "Service Architecture, Prototype Description, and Network Implications of A Personalized Information Grazing Service," INFOCOM'90, Ninth Annual Joint Conference of the IEEE Computer and Communication Societies, Jun. 3-7 1990, http://slrohall.com/publications/, 8 pages.
Buzo, A., et al., "Speech Coding Based Upon Vector Quantization," IEEE Transactions on Acoustics, Speech, and Signal Processing, vol. Assp-28, No. 5, Oct. 1980, 13 pages.
Caminero-Gil, J., et al., "Data-Driven Discourse Modeling for Semantic Interpretation," In Proceedings of the IEEE International Conference on Acoustics, Speech, and Signal Processing, May 7-10, 1996, 6 pages.
Cawley, G. C., "The Application of Neural Networks to Phonetic Modelling," PhD Thesis, University of Essex, Mar. 1996, 13 pages.
Chang, S., et al., "A Segment-based Speech Recognition System for Isolated Mandarin Syllables," Proceedings TENCON '93, IEEE Region 10 conference on Computer, Communication, Control and Power Engineering, Oct. 19-21, 1993, vol. 3, 6 pages.
Conklin, J., "Hypertext: An Introduction and Survey," Computer Magazine, Sep. 1987, 25 pages.

(56) References Cited

OTHER PUBLICATIONS

Connolly, F. T., et al., "Fast Algorithms for Complex Matrix Multiplication Using Surrogates," IEEE Transactions on Acoustics, Speech, and Signal Processing, Jun. 1989, vol. 37, No. 6, 13 pages.
Deerwester, S., et al., "Indexing by Latent Semantic Analysis," Journal of the American Society for Information Science, vol. 41, No. 6, Sep. 1990, 19 pages.
Deller, Jr., J. R., et al., "Discrete-Time Processing of Speech Signals," © 1987 Prentice Hall, ISBN: 0-02-328301-7, 14 pages.
Digital Equipment Corporation, "Open VMS Software Overview," Dec. 1995, software manual, 159 pages.
Donovan, R. E., "A New Distance Measure for Costing Spectral Discontinuities in Concatenative Speech Synthesisers," 2001, http://citeseerx.ist.psu.edu/viewdoc/summary?doi=10.1.1.21.6398, 4 pages.
Frisse, M. E., "Searching for Information in a Hypertext Medical Handbook," Communications of the ACM, vol. 31, No. 7, Jul. 1988, 8 pages.
Goldberg, D., et al., "Using Collaborative Filtering to Weave an Information Tapestry," Communications of the ACM, vol. 35, No. 12, Dec. 1992, 10 pages.
Gorin, A. L., et al., "On Adaptive Acquisition of Language," International Conference on Acoustics, Speech, and Signal Processing (ICASSP'90), vol. 1, Apr. 3-6, 1990, 5 pages.
Gotoh, Y., et al., "Document Space Models Using Latent Semantic Analysis," In Proceedings of Eurospeech, 1997, 4 pages.
Gray, R. M., "Vector Quantization," IEEE ASSP Magazine, Apr. 1984, 26 pages.
Harris, F. J., "On the Use of Windows for Harmonic Analysis with the Discrete Fourier Transform," In Proceedings of the IEEE, vol. 66, No. 1, Jan. 1978, 34 pages.
Helm, R., et al., "Building Visual Language Parsers," In Proceedings of CHI'91 Proceedings of the SIGCHI Conference on Human Factors in Computing Systems, 8 pages.
Hermansky, H., "Perceptual Linear Predictive (PLP) Analysis of Speech," Journal of the Acoustical Society of America, vol. 87, No. 4, Apr. 1990, 15 pages.
Hermansky, H., "Recognition of Speech in Additive and Convolutional Noise Based on Rasta Spectral Processing," In proceedings of IEEE International Conference on Acoustics, speech, and Signal Processing (ICASSP'93), Apr. 27-30, 1993, 4 pages.
Hoehfeld M., et al., "Learning with Limited Numerical Precision Using the Cascade-Correlation Algorithm," IEEE Transactions on Neural Networks, vol. 3, No. 4, Jul. 1992, 18 pages.
Holmes, J. N., "Speech Synthesis and Recognition—Stochastic Models for Word Recognition," Speech Synthesis and Recognition, Published by Chapman & Hall, London, ISBN 0 412 534304, © 1998 J. N. Holmes, 7 pages.
Hon, H.W., et al., "CMU Robust Vocabulary—Independent Speech Recognition System," IEEE International Conference on Acoustics, Speech, and Signal Processing (ICASSP-91), Apr. 14-17, 1991, 4 pages.
IBM Technical Disclosure Bulletin, "Speech Editor," vol. 29, No. 10, Mar. 10, 1987, 3 pages.
IBM Technical Disclosure Bulletin, "Integrated Audio-Graphics User Interface," vol. 33, No. 11, Apr. 1991, 4 pages.
IBM Technical Disclosure Bulletin, "Speech Recognition with Hidden Markov Models of Speech Waveforms," vol. 34, No. 1, Jun. 1991, 10 pages.
Iowegian International, "FIR Filter Properties," dspGuro, Digital Signal Processing Central, http://www.dspguru.com/dsp/tags/fir/properties, downloaded on Jul. 28, 2010, 6 pages.
Jacobs, P. S., et al., "Scisor: Extracting Information from On-Line News," Communications of the ACM, vol. 33, No. 11, Nov. 1990, 10 pages.
Jelinek, F., "Self-Organized Language Modeling for Speech Recognition," Readings in Speech Recognition, edited by Alex Waibel and Kai-Fu Lee, May 15, 1990, © 1990 Morgan Kaufmann Publishers, Inc., ISBN: 1-55860-124-4, 63 pages.
Jennings, A., et al., "A Personal News Service Based on a User Model Neural Network," IEICE Transactions on Information and Systems, vol. E75-D, No. 2, Mar. 1992, Tokyo, JP, 12 pages.
Ji, T., et al., "A Method for Chinese Syllables Recognition based upon Sub-syllable Hidden Markov Model," 1994 International Symposium on Speech, Image Processing and Neural Networks, Apr. 13-16, 1994, Hong Kong, 4 pages.
Jones, J., "Speech Recognition for Cyclone," Apple Computer, Inc., E.R.S., Revision 2.9, Sep. 10, 1992, 93 pages.
Katz, S. M., "Estimation of Probabilities from Sparse Data for the Language Model Component of a Speech Recognizer," IEEE Transactions on Acoustics, Speech, and Signal Processing, vol. ASSP-35, No. 3, Mar. 1987, 3 pages.
Kitano, H., "PhiDM-Dialog, An Experimental Speech-to-Speech Dialog Translation System," Jun. 1991 Computer, vol. 24, No. 6, 13 pages.
Klabbers, E., et al., "Reducing Audible Spectral Discontinuities," IEEE Transactions on Speech and Audio Processing, vol. 9, No. 1, Jan. 2001, 13 pages.
Klatt, D. H., "Linguistic Uses of Segmental Duration in English: Acoustic and Perpetual Evidence," Journal of the Acoustical Society of America, vol. 59, No. 5, May 1976, 16 pages.
Kominek, J., et al., "Impact of Durational Outlier Removal from Unit Selection Catalogs," 5th ISCA Speech Synthesis Workshop, Jun. 14-16, 2004, 6 pages.
Kubala, F., et al., "Speaker Adaptation from a Speaker-Independent Training Corpus," International Conference on Acoustics, Speech, and Signal Processing (ICASSP'90), Apr. 3-6, 1990, 4 pages.
Kubala, F., et al., "The Hub and Spoke Paradigm for CSR Evaluation," Proceedings of the Spoken Language Technology Workshop, Mar. 6-8, 1994, 9 pages.
Lee, K.F., "Large-Vocabulary Speaker-Independent Continuous Speech Recognition: The Sphinx System," Apr. 18, 1988, Partial fulfillment of the requirements for the degree of Doctor of Philosophy, Computer Science Department, Carnegie Mellon University, 195 pages.
Lee, L., et al., "A Real-Time Mandarin Dictation Machine for Chinese Language with Unlimited Texts and Very Large Vocabulary," International Conference on Acoustics, Speech and Signal Processing, vol. 1, Apr. 3-6, 1990, 5 pages.
Lee, L, et al., "Golden Mandarin(II)—-An Improved Single-Chip Real-Time Mandarin Dictation Machine for Chinese Language with Very Large Vocabulary," 0-7803-0946-4/93 ©1993IEEE, 4 pages.
Lee, L, et al., "Golden Mandarin(II)—An Intelligent Mandarin Dictation Machine for Chinese Character Input with Adaptation/Learning Functions," International Symposium on Speech, Image Processing and Neural Networks, Apr. 13-16, 1994, Hong Kong, 5 pages.
Lee, L., et al., "System Description of Golden Mandarin (I) Voice Input for Unlimited Chinese Characters," International Conference on Computer Processing of Chinese & Oriental Languages, vol. 5, Nos. 3 & 4, Nov. 1991, 16 pages.
Lin, C.H., et al., "A New Framework for Recognition of Mandarin Syllables With Tones Using Sub-syllabic Unites," IEEE International Conference on Acoustics, Speech, and Signal Processing (ICASSP-93), Apr. 27-30, 1993, 4 pages.
Linde, Y., et al., "An Algorithm for Vector Quantizer Design," IEEE Transactions on Communications, vol. 28, No. 1, Jan. 1980, 12 pages.
Liu, F.H., et al., "Efficient Joint Compensation of Speech for the Effects of Additive Noise and Linear Filtering," IEEE International Conference of Acoustics, Speech, and Signal Processing, ICASSP-92, Mar. 23-26, 1992, 4 pages.
Logan, B., "Mel Frequency Cepstral Coefficients for Music Modeling," In International Symposium on Music Information Retrieval, 2000, 2 pages.
Lowerre, B. T., "The-HARPY Speech Recognition System," Doctoral Dissertation, Department of Computer Science, Carnegie Mellon University, Apr. 1976, 20 pages.
Maghbouleh, A., "An Empirical Comparison of Automatic Decision Tree and Linear Regression Models for Vowel Durations," Revised version of a paper presented at the Computational Phonology in Speech Technology workshop, 1996 annual meeting of the Association for Computational Linguistics in Santa Cruz, California, 7 pages.

(56) References Cited

OTHER PUBLICATIONS

Markel, J. D., et al., "Linear Prediction of Speech," Springer-Verlag, Berlin Heidelberg New York 1976, 12 pages.
Morgan, B., "Business Objects," (Business Objects for Windows) Business Objects Inc., DBMS Sep. 1992, vol. 5, No. 10, 3 pages.
Mountford, S. J., et al., "Talking and Listening to Computers," The Art of Human-Computer Interface Design, Copyright © 1990 Apple Computer, Inc. Addison-Wesley Publishing Company, Inc., 17 pages.
Murty, K. S. R., et al., "Combining Evidence from Residual Phase and MFCC Features for Speaker Recognition," IEEE Signal Processing Letters, vol. 13, No. 1, Jan. 2006, 4 pages.
Murveit H. et al., "Integrating Natural Language Constraints into HMM-based Speech Recognition," 1990 International Conference on Acoustics, Speech, and Signal Processing, Apr. 3-6, 1990, 5 pages.
Nakagawa, S., et al., "Speaker Recognition by Combining MFCC and Phase Information," IEEE International Conference on Acoustics Speech and Signal Processing (ICASSP), Mar. 14-19, 2010, 4 pages.
Niesler, T. R., et al., "A Variable-Length Category-Based *N*-Gram Language Model," IEEE International Conference on Acoustics, Speech, and Signal Processing (ICASSP'96), vol. 1, May 7-10, 1996, 6 pages.
Papadimitriou, C. H., et al., "Latent Semantic Indexing: A Probabilistic Analysis," Nov. 14, 1997, http://citeseerx.ist.psu.edu/messages/downloadsexceeded.html, 21 pages.
Parsons, T. W., "Voice and Speech Processing," Linguistics and Technical Fundamentals, Articulatory Phonetics and Phonemics, © 1987 McGraw-Hill, Inc., ISBN: 0-07-0485541-0, 5 pages.
Parsons, T. W., "Voice and Speech Processing," Pitch and Formant Estimation, © 1987 McGraw-Hill, Inc., ISBN: 0-07-0485541-0, 15 pages.
Picone, J., "Continuous Speech Recognition Using Hidden Markov Models," IEEE ASSP Magazine, vol. 7, No. 3, Jul. 1990, 16 pages.
Rabiner, L. R., et al., "Fundamental of Speech Recognition," © 1993 AT&T, Published by Prentice-Hall, Inc., ISBN: 0-13-285826-6, 17 pages.
Rabiner, L. R., et al., "Note on the Properties of a Vector Quantizer for LPC Coefficients," The Bell System Technical Journal, vol. 62, No. 8, Oct. 1983, 9 pages.
Ratcliffe, M., "ClearAccess 2.0 allows SQL searches off-line," (Structured Query Language), ClearAcess Corp., MacWeek Nov. 16, 1992, vol. 6, No. 41, 2 pages.
Remde, J. R., et al., "SuperBook: An Automatic Tool for Information Exploration-Hypertext'?," In Proceedings of Hypertext'87 papers, Nov. 13-15, 1987, 14 pages.
Reynolds, C. F., "On-Line Reviews: A New Application of the HICOM Conferencing System," IEE Colloquium on Human Factors in Electronic Mail and Conferencing Systems, Feb. 3, 1989, 4 pages.
Rigoll, G., "Speaker Adaptation for Large Vocabulary Speech Recognition Systems Using Speaker Markov Models," International Conference on Acoustics, Speech, and Signal Processing (ICASSP'89), May 23-26, 1989, 4 pages.
Riley, M. D., "Tree-Based Modelling of Segmental Durations," Talking Machines Theories, Models, and Designs, 1992 © Elsevier Science Publishers B.V., North-Holland, ISBN: 08-444-89115.3, 15 pages.
Rivoira, S., et al., "Syntax and Semantics in a Word-Sequence Recognition System," IEEE International Conference on Acoustics, Speech, and Signal Processing (ICASSP'79), Apr. 1979, 5 pages.
Rosenfeld, R., "A Maximum Entropy Approach to Adaptive Statistical Language Modelling," Computer Speech and Language, vol. 10, No. 3, Jul. 1996, 25 pages.
Roszkiewicz, A., "Extending your Apple," Back Talk—Lip Service, A+ Magazine, The Independent Guide for Apple Computing, vol. 2, No. 2, Feb. 1984, 5 pages.
Sakoe, H., et al., "Dynamic Programming Algorithm Optimization for Spoken Word Recognition," IEEE Transactins on Acoustics, Speech, and Signal Processing, Feb. 1978, vol. ASSP-26 No. 1, 8 pages.
Salton, G., et al., "On the Application of Syntactic Methodologies in Automatic Text Analysis," Information Processing and Management, vol. 26, No. 1, Great Britain 1990, 22 pages.
Savoy, J., "Searching Information in Hypertext Systems Using Multiple Sources of Evidence," International Journal of Man-Machine Studies, vol. 38, No. 6, Jun. 1993, 15 pages.
Scagliola, C., "Language Models and Search Algorithms for Real-Time Speech Recognition," International Journal of Man-Machine Studies, vol. 22, No. 5, 1985, 25 pages.
Schmandt, C., et al., "Augmenting a Window System with Speech Input," IEEE Computer Society, Computer Aug. 1990, vol. 23, No. 8, 8 pages.
Schütze, H., "Dimensions of Meaning," Proceedings of Supercomputing'92 Conference, Nov. 16-20, 1992, 10 pages.
Sheth B., et al., "Evolving Agents for Personalized Information Filtering," In Proceedings of the Ninth Conference on Artificial Intelligence for Applications, Mar. 1-5, 1993, 9 pages.
Shikano, K., et al., "Speaker Adaptation Through Vector Quantization," IEEE International Conference on Acoustics, Speech, and Signal Processing (ICASSP'86), vol. 11, Apr. 1986, 4 pages.
Sigurdsson, S., et al., "Mel Frequency Cepstral Coefficients: An Evaluation of Robustness of MP3 Encoded Music," In Proceedings of the 7th International Conference on Music Information Retrieval (ISMIR), 2006, 4 pages.
Silverman, K. E. A., et al., "Using a Sigmoid Transformation for Improved Modeling of Phoneme Duration," Proceedings of the IEEE International Conference on Acoustics, Speech, and Signal Processing, Mar. 15-19, 1999, 5 pages.
Tenenbaum, A.M., et al., "Data Structure Using Pascal," 1981 Prentice-Hall, Inc., 34 pages.
Tsai, W.H., et al., "Attributed Grammar—A Tool for Combining Syntactic and Statistical Approaches to Pattern Recognition," IEEE Transactions on Systems, Man, and Cybernetics, vol. SMC-10, No. 12, Dec. 1980, 13 pages.
Udell, J., "Computer Telephony," BYTE, vol. 19, No. 7, Jul. 1, 1994, 9 pages.
van Santen, J. P. H., "Contextual Effects on Vowel Duration," Journal Speech Communication, vol. 11, No. 6, Dec. 1992, 34 pages.
Vepa, J., et al., "New Objective Distance Measures for Spectral Discontinuities in Concatenative Speech Synthesis," In Proceedings of the IEEE 2002 Workshop on Speech Synthesis, 4 pages.
Verschelde, J., "MATLAB Lecture 8. Special Matrices in MATLAB," Nov. 23, 2005, UIC Dept. of Math., Stat.. & C.S., MCS 320, Introduction to Symbolic Computation, 4 pages.
Vingron, M. "Near-Optimal Sequence Alignment," Deutsches Krebsforschungszentrum (DKFZ), Abteilung Theoretische Bioinformatik, Heidelberg, Germany, Jun. 1996, 20 pages.
Werner, S., et al., "Prosodic Aspects of Speech," Université de Lausanne, Switzerland, 1994, Fundamentals of Speech Synthesis and Speech Recognition: Basic Concepts, State of the Art, and Future Challenges, 18 pages.
Wolff, M., "Poststructuralism and the Artful Database: Some Theoretical Considerations," Information Technology and Libraries, vol. 13, No. 1, Mar. 1994, 10 pages.
Wu, M., "Digital Speech Processing and Coding," ENEE408G Capstone-Multimedia Signal Processing, Spring 2003, Lecture-2 course presentation, University of Maryland, College Park, 8 pages.
Wu, M., "Speech Recognition, Synthesis, and H.C.I.," ENEE408G Capstone-Multimedia Signal Processing, Spring 2003, Lecture-3 course presentation, University of Maryland, College Park, 11 pages.
Wyle, M. F., "A Wide Area Network Information Filter," In Proceedings of First International Conference on Artificial Intelligence on Wall Street, Oct. 9-11, 1991, 6 pages.
Yankelovich, N., et al., "Intermedia: The Concept and the Construction of a Seamless Information Environment," Computer Magazine, Jan. 1988, © 1988 IEEE, 16 pages.
Yoon, K., et al., "Letter-to-Sound Rules for Korean," Department of Linguistics, The Ohio State University, 2002, 4 pages.
Zhao, Y., "An Acoustic-Phonetic-Based Speaker Adaptation Technique for Improving Speaker-Independent Continuous Speech Recognition," IEEE Transactions on Speech and Audio Processing, vol. 2, No. 3, Jul. 1994, 15 pages.

(56) References Cited

OTHER PUBLICATIONS

International Search Report dated Nov. 9, 1994, received in International Application No. PCT/US1993/12666, which corresponds to U.S. Appl. No. 07/999,302, 8 pages (Robert Don Strong).

International Preliminary Examination Report dated Mar. 1, 1995, received in International Application No. PCT/US1993/12666, which corresponds to U.S. Appl. No. 07/999,302, 5 pages (Robert Don Strong).

International Preliminary Examination Report dated Apr. 10, 1995, received in International Application No. PCT/US1993/12637, which corresponds to U.S. Appl. No. 07/999,354, 7 pages (Alejandro Acero).

International Search Report dated Feb. 8, 1995, received in International Application No. PCT/US1994/11011, which corresponds to U.S. Appl. No. 08/129,679, 7 pages (Yen-Lu Chow).

International Preliminary Examination Report dated Feb. 28, 1996, received in International Application No. PCT/US1994/11011, which corresponds to U.S. Appl. No. 08/129,679, 4 pages (Yen-Lu Chow).

Written Opinion dated Aug. 21, 1995, received in International Application No. PCT/US1994/11011, which corresponds to U.S. Appl. No. 08/129,679, 4 pages (Yen-Lu Chow).

International Search Report dated Nov. 8, 1995, received in International Application No. PCT/US1995/08369, which corresponds to U.S. Appl. No. 08/271,639, 6 pages (Peter V. De Souza).

International Preliminary Examination Report dated Oct. 9, 1996, received in International Application No. PCT/US1995/08369, which corresponds to U.S. Appl. No. 08/271,639, 4 pages (Peter V. De Souza).

* cited by examiner

700

800

CONTEXT-AWARE UNIT SELECTION

FIELD OF THE INVENTION

The present invention relates generally to language processing. More particularly, this invention relates to weighting of unit characteristics in language processing.

BACKGROUND

Concatenative text-to-speech ("TTS") synthesis generates the speech waveform corresponding to a given sequence of phonemes through the sequential assembly of pre-recorded segments of speech. These segments may be extracted from sentences uttered by a professional speaker, and stored in a database. Each such segment is usually referred to as a unit. During synthesis, the database may be searched for the most appropriate unit to be spoken at any given time, a process known as unit selection. This selection typically relies on a plurality of characteristics reflecting, for example, the degree of discontinuity from the previous unit, the departure from ideal values for pitch and duration, the spectral quality relative to the average matching unit present in the database, the location of the candidate unit in the recorded utterance, etc.

To select the unit, two requirements need to be fulfilled: (i) each individual characteristic needs to meaningfully score each potential candidate relative to all other available candidates, and (ii) these individual scores needs to be appropriately combined into a final score, which then may serve as the basis for unit selection.

The typical approaches to achieve requirement (ii) have been to consider a linear combination of the various scores, where the weights are empirically determined via careful human listening. In that case the synthesized material is inherently limited to a tractably small number of sentences, sometimes not even particularly representative of the eventual (unknown) domain of use. That is, in the existing techniques, the weights are manually tuned in a global fashion by listening to a necessarily small amount of synthesized material. Additionally, the existing techniques define weightings for the entire corpus of samples and apply those defined weightings across all samples.

These strategies have obvious drawbacks, including a lack of scalability and the need for human supervision. Most importantly, they often lead to a set of weights which fails to generalize beyond the initial set of sentences considered. In other words, in the existing techniques there is no guarantee that the weights obtained by "trial and error" approach will generalize to new material. In fact, because no single combination of scores can possibly be optimal for all concatenations, these techniques are essentially counter-productive.

Alternatively, it is also possible to view each scoring source as generating a separate stream of information, and apply standard voting methods and other known learning/classification techniques to try to combine the ensuing outcomes. Unfortunately, the various streams tend to (i) be correlated with each other in complex, time-varying ways, and (ii) differ unpredictably in their discriminative value depending on context, thereby violating many of the assumptions implicitly underlying such techniques.

SUMMARY OF THE DESCRIPTION

Methods and apparatuses to perform context-aware unit selection for natural language processing are described. Dynamic characteristics ("streams of information") associated with input units may be received. An input unit of the sequence of input units may be a phoneme, a diphone, a syllable, a half phone, a word, or a sequence thereof. A stream of information of the streams of information associated with the input units may represent, for example, a pitch, duration, position, accent, spectral quality, a part-of-speech, any other relevant characteristic that can be associated with the input unit, or any combination thereof. In one embodiment, the stream of information includes a cost function. The streams of information may be analyzed in a context associated with a pool of candidate units to determine a distribution of the streams of information over the candidate units. For example, a stream of information that varies the most within the pool of the candidate units may be determined. A first set of weights of the streams of information may be automatically determined according to the distribution of the streams of information within the pool of candidate units. A first candidate unit is selected from the pool based on the automatically determined set of weights of the streams of information. Further, the streams of information are analyzed in the context associated with a pool of second candidate units to automatically determine a second set of weights of the streams of information associated with the second candidate units. A second candidate unit is selected from the pool of second candidate units to concatenate with the first candidate unit based on the second set of weights of the streams of information. In one embodiment, the sets of streams of information are automatically dynamically computed at each concatenation.

In one embodiment, the analyzing of the streams of information includes weighting a stream of information higher if the stream of information provides a high discrimination between the candidate units. In one embodiment, the analyzing of the streams of information includes weighting a stream of information lower if the stream of information provides a low discrimination between the candidate units.

In one embodiment, scores associated with streams of information for candidate units associated with an input unit are determined. A matrix of the scores for the candidate units may be generated. A set of weights may be determined using the matrix. First final costs for the candidate units using the set of weights may be determined. A candidate unit may be selected from the candidate units based on the final costs.

Other features will be apparent from the accompanying drawings and from the detailed description which follows.

BRIEF DESCRIPTION OF THE DRAWINGS

The present invention is illustrated by way of example and not limitation in the figures of the accompanying drawings in which like references indicate similar elements.

DETAILED DESCRIPTION

The subject invention will be described with references to numerous details set forth below, and the accompanying drawings will illustrate the invention. The following description and drawings are illustrative of the invention and are not to be construed as limiting the invention. Numerous specific details are described to provide a thorough understanding of the present invention. However, in certain instances, well known or conventional details are not described in order to not unnecessarily obscure the present invention in detail.

Reference throughout the specification to "one embodiment", "another embodiment", or "an embodiment" means that a particular feature, structure, or characteristic described in connection with the embodiment is included in at least one embodiment of the present invention. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Methods and apparatuses to perform context-aware unit selection for natural language processing and a system having a computer readable medium containing executable program code to perform context-aware unit selection for natural language processing are described below. A machine-readable medium may include any mechanism for storing information in a form readable by a machine (e.g., a computer). For example, a machine-readable medium includes read only memory ("ROM"); random access memory ("RAM"); magnetic disk storage media; optical storage media; and flash memory devices.

Figure 1:
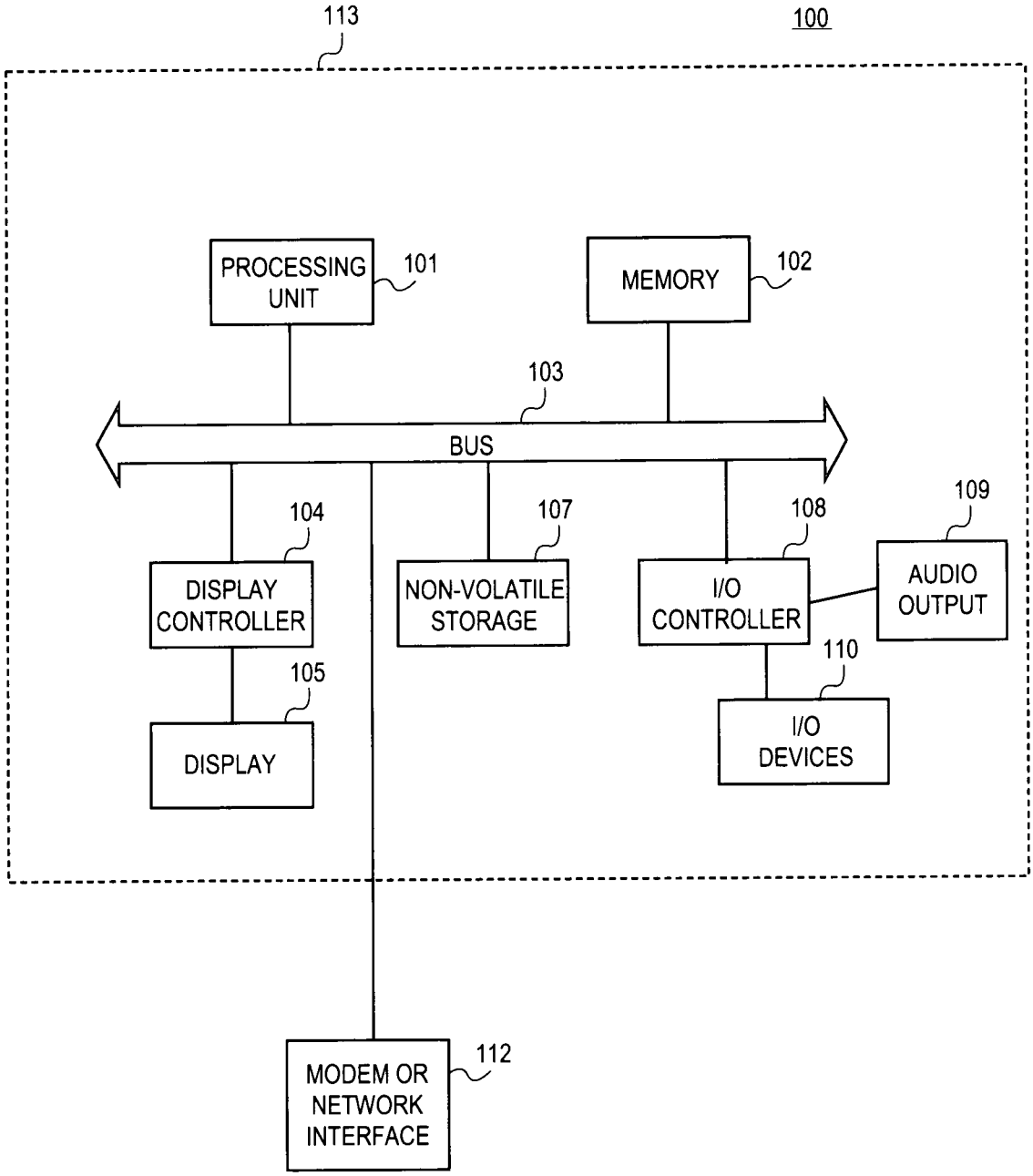
FIG. 1 shows a block diagram of a data processing system to perform context-aware unit selection for natural language processing according to one embodiment of invention.

FIG. 1 shows a block diagram 100 of a data processing system to perform context-aware unit selection for natural language processing according to one embodiment of invention. Data processing system 113 includes a processing unit 101 that may include a microprocessor, such as an Intel Pentium® microprocessor, Motorola Power PC® microprocessor, Intel Core™ Duo processor, AMD Athlon™ processor, AMD Turion™ processor, AMD Sempron™ processor, and any other microprocessor. Processing unit 101 may include a personal computer (PC), such as a Macintosh® (from Apple Inc. of Cupertino, Calif.), Windows®-based PC (from Microsoft Corporation of Redmond, Wash.), or one of a wide variety of hardware platforms that run the UNIX operating system or other operating systems. For one embodiment, processing unit 101 includes a general purpose data processing system based on the PowerPC®, Intel Core™ Duo, AMD Athlon™, AMD Turion™ processor, AMD Sempron™, HP Pavilion™ PC, HP Compaq™ PC, and any other processor families. Processing unit 101 may be a conventional microprocessor such as an Intel Pentium microprocessor or Motorola Power PC microprocessor.

As shown in FIG. 1, memory 102 is coupled to the processing unit 101 by a bus 103. Memory 102 can be dynamic random access memory (DRAM) and can also include static random access memory (SRAM). A bus 103 couples processing unit 101 to the memory 102 and also to non-volatile storage 107 and to display controller 104 and to the input/output (I/O) controller 108. Display controller 104 controls in the conventional manner a display on a display device 105 which can be a cathode ray tube (CRT) or liquid crystal display (LCD). The input/output devices 110 can include a keyboard, disk drives, printers, a scanner, and other input and output devices, including a mouse or other pointing device. One or more input devices 110, such as a scanner, keyboard, mouse or other pointing device can be used to input a text for speech synthesis. The display controller 104 and the I/O controller 108 can be implemented with conventional well known technology. An audio output 109, for example, one or more speakers may be coupled to an I/O controller 108 to produce speech. The non-volatile storage 107 is often a magnetic hard disk, an optical disk, or another form of storage for large amounts of data. Some of this data is often written, by a direct memory access process, into memory 102 during execution of software in the data processing system 113. One of skill in the art will immediately recognize that the terms "computer-readable medium" and "machine-readable medium" include any type of storage device that is accessible by the processing unit 101. A data processing system 113 can interface to external systems through a modem or network interface 112. It will be appreciated that the modem or network interface 112 can be considered to be part of the data processing system 113. This interface 112 can be an analog modem, ISDN modem, cable modem, token ring interface, satellite transmission interface, or other interfaces for coupling a data processing system to other data processing systems.

It will be appreciated that data processing system 113 is one example of many possible data processing systems which have different architectures. For example, personal computers based on an Intel microprocessor often have multiple buses, one of which can be an input/output (I/O) bus for the peripherals and one that directly connects the processing unit 101 and the memory 102 (often referred to as a memory bus). The buses are connected together through bridge components that perform any necessary translation due to differing bus protocols.

Network computers are another type of data processing system that can be used with the embodiments of the present invention. Network computers do not usually include a hard disk or other mass storage, and the executable programs are loaded from a network connection into the memory 102 for execution by the processing unit 101. A Web TV system, which is known in the art, is also considered to be a data processing system according to the embodiments of the present invention, but it may lack some of the features shown in FIG. 1, such as certain input or output devices. A typical data processing system will usually include at least a processor, memory, and a bus coupling the memory to the processor.

It will also be appreciated that the data processing system 113 is controlled by operating system software which includes a file management system, such as a disk operating system, which is part of the operating system software. One example of operating system software is the family of operating systems known as Macintosh® Operating System (Mac OS®) or Mac OS X® from Apple Inc. of Cupertino, Calif. Another example of operating system software is the family of operating systems known as Windows® from Microsoft Corporation of Redmond, Wash., and their associated file management systems. The file management system is typically stored in the non-volatile storage 107 and causes the processing unit 101 to execute the various acts required by the operating system to input and output data and to store data in memory, including storing files on the non-volatile storage 107.

Figure 2:
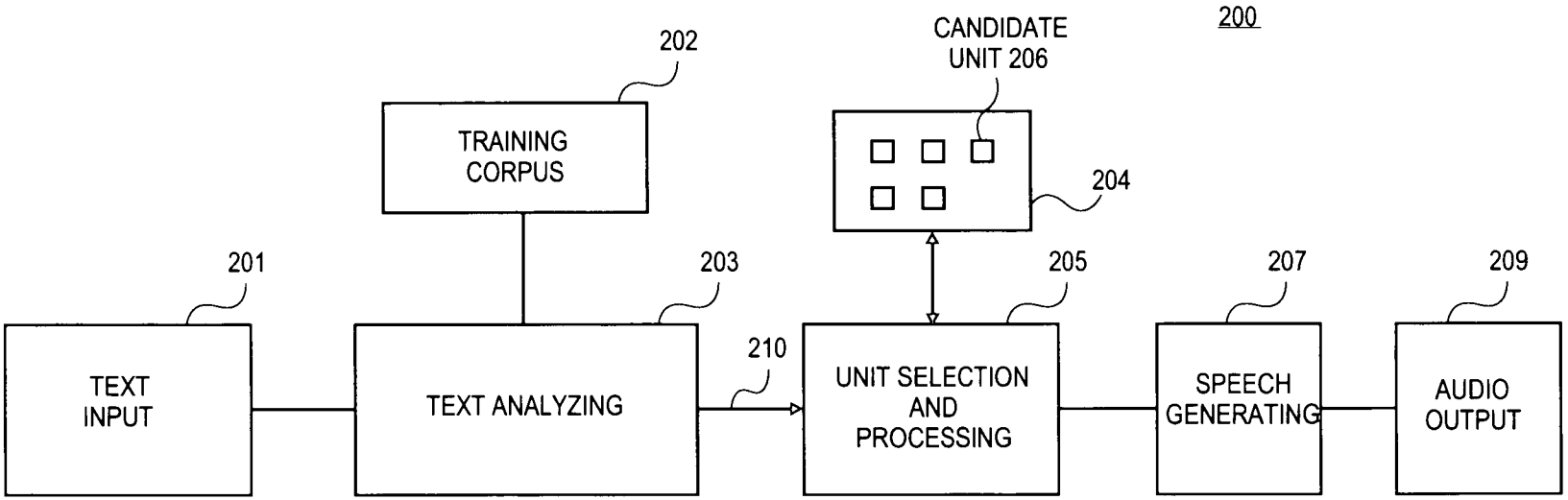
FIG. 2 shows a block diagram illustrating a data processing system to perform context-aware unit selection for natural language processing according to one embodiment of the invention.

FIG. 2 shows a block diagram illustrating a data processing system to perform context-aware unit selection for natural language processing according to one embodiment of the invention. Generally, the context-aware unit selection may be performed for many natural language processing ("NLP") applications, for example, from low-level applications, such as grammar checking and text chunking, to high-level applications, such as text-to-speech synthesis ("TTS"), speech recognition and machine translation applications. In one embodiment, data processing system 200 performs context-aware unit selection based on optimal cost weighting for text-to-speech ("TTS") synthesis. A text analyzing module 203 may receive a text input 201, for example, one or more words, sentences, paragraphs, and the like. Text analyzing module 203 may analyze the text to extract units. The extracted units may include a phoneme, a diphone (the span between the middle of one phoneme and the middle of another phoneme), a syllable, a half phone, a word, or any combination thereof. Analyzing unit 203 may determine characteristics of a unit and assign these characteristics to the unit. The characteristics of the unit may be, for example, a pitch, duration, accent, spectral quality, position in a sequence of units, degree of discontinuity from a previous unit, a part-of-speech characteristic, any other relevant characteristic that can be extracted from a signal associated with a unit, and any combination thereof. The characteristics of the input sentence to be synthesized into speech may be determined based on models indicating how these characteristics (e.g., a pitch) should evolve for that input sentence, what the optimal duration of each word in the sentence should be, and/or where to place an accent, for example. In one embodiment, analyzing unit 203 analyzes the input text to assign the characteristics to the input units that indicate how the input sentence should be spoken.

In one embodiment, analyzing unit 203 may determine a part-of-speech characteristic to an extracted word. The part-of-speech characteristic typically defines whether a word in a sentence is, for example, a noun, verb, adjective, preposition, and/or the like. In one embodiment, analyzing unit 203 analyzes text input 201 to determine a POS characteristic of a word of input text 201 using a latent semantic analogy, as described in a co-pending patent application Ser. No. 11/906,592 entitled "PART-OF-SPEECH TAGGING using LATENT ANALOGY" filed on Oct. 2, 2007, which is incorporated herein in its entirety.

As shown in FIG. 2, system 200 includes a training corpus 202 that contains a pool of training words and training word sequences. Training corpus 202 may be stored in a memory incorporated into text analyzing module 203, and/or be stored in a separate entity coupled to text analyzing module 203. In one embodiment, text analyzing module 203 determines a POS characteristic of a word from input text 201 by selecting one or more word sequences from the training corpus 202. In one embodiment, text analyzing module 203 assigns POS tags to words of the input text.

As shown in FIG. 2, text analyzing module 203 passes one or more extracted input units and their associated characteristics ("streams of information") to unit selection and processing module 205. As shown in FIG. 2, unit selection and processing module 205 receives streams of information associated with input units 210. Unit selection and processing module 205 may select a candidate unit from a pool 204 of candidate units, such as a candidate unit 206, based on the received input unit and the streams of information associated with the input unit.

Unit selection and processing module 205 analyzes the streams of information in a context associated with pool 204 of candidate units. For example, an input word "apple" is passed from text analyzing module 203 to module 205. Module 205 searches for a candidate word "apple" from pool 204 based on the streams of information 210 associated with input word "apple". The pool 204 may contain, for example 1 to hundreds or more candidate words "apple". The candidate words in the pool 204 may come from different utterances and have different characteristics attached. For example, the candidate words "apple" may have different pitch characteristics. The candidate words may have different position characteristics. For example, the words that come from the end of the sentence are typically pronounced longer than words from the other positions in the sentence. The candidate words may have different accent characteristics. Pool 204 may be stored in a memory incorporated into unit selection and processing module 205, and/or be stored in a separate entity coupled to unit selection and processing module 205.

Module 205 may compute a measure for each candidate word "apple" from the pool that indicates how the stream of information for each of candidate units deviates from the stream of information associated the input unit, or ideal unit. For example, the measure may be a cost function that is calculated for each candidate unit to indicate how the pitch, duration, or accent deviates from an ideal contour. Unit selection and processing module 205 may select a candidate unit from pool 204 that is the best for the sentence to be synthesized based on the measure.

In one embodiment, unit selection and processing module 205 analyzes streams of information 210 in the context associated with pool 204 of candidate units to determine an optimal set (combination) of the streams of information. That is, the determined combination of streams of information to properly select a candidate unit from the pool of candidate units is context aware. In one embodiment, the context of the pool 204 of candidate units is analyzed to determine which streams of information are more important and which streams of information are less important in a combination of the streams of information. In one embodiment, to determine this, the streams of information associated with candidate units are evaluated, and the stream of information that vary more across all candidate units from the pool are considered as more important, and the streams of information that vary less across all candidate units from the pool are considered less important. For example, if all candidate units have substantially the same duration, so they substantially are not discriminated between each other in duration, the duration information may be considered as less important. For example, if the candidate units vary strongly in pitch, so they are substantially discriminated between each other in pitch, the pitch information is considered more important. In one embodiment, the weight zero is assigned to the stream of information that is least important, and weight 1 may be assigned to the stream of information that is most important in the set of streams of information. That is, the available mass for the weights is distributed on one or more streams of information that are important to discriminate between the candidate units. In one embodiment, a first candidate unit is selected from the pool 206 based on the first set of the streams of information, as described in further detail below.

In one embodiment, unit selection and processing module 205 analyzes the streams of information in the context associated with a pool of second candidate units to determine a second set of weights of the streams of information. Unit selection and processing module 205 selects a second candidate unit from the pool of second candidate units based on the second set of weights of the streams of information. In one embodiment, unit selection and processing module 205 concatenates second candidate unit with the first candidate unit. That is, the optimal sets (combinations) of streams of information are computed dynamically at each concatenation of one unit with another unit. The weights of each of the streams of information in the combination are adjusted locally, at each concatenation to determine an optimal combination of streams of information (e.g., costs) for each concatenation. The weights of each of the streams of information vary dynamically from concatenation to concatenation, based on what is needed at a particular point in time, as well as what is available at this particular point in time. In one embodiment, a set of optimal weights is computed dynamically (e.g., on a per concatenation basis) so as to maximize discrimination between the candidate units, such as candidate unit 206, by the unit selection process at each concatenation, as described in further detail below.

Such dynamic, local approach, as opposed to just global adjustment, leads to the selection of better individual units, and makes the entire process more consistent across the different concatenations considered, for example, in Viterbi search. In one embodiment, unit selection and processing module 205 concatenates selected units together, smoothes the transitions between the concatenated units, and passes the concatenated units to a speech generating module 207 to enable the generation of a naturalized audio output 209, for example, an utterance, spoken paragraph, and the like.

Figure 3:
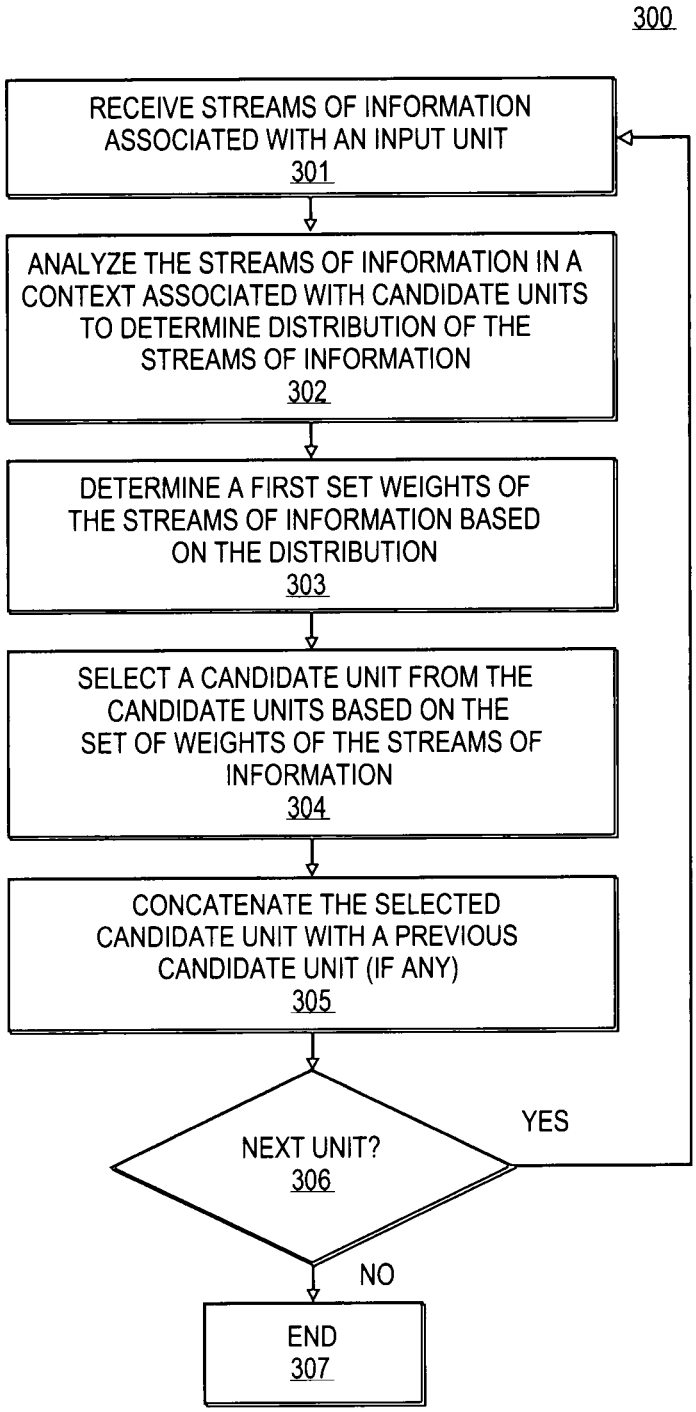
FIG. 3 shows a flowchart of one embodiment of a method to perform a content-aware unit selection for natural language processing.

FIG. 3 shows a flowchart of one embodiment of a method to perform a content-aware unit selection for natural language processing. Method 300 begins with operation 301 that involves receiving streams of information associated with an input unit of a set of one or more input units , for example, streams of information 210, as described above with respect to FIG. 2. The streams of information (characteristics) may represent, for example, a pitch, duration, position, accent, spectral quality, a part-of-speech, any other relevant characteristic that can be extracted from a signal associated with an input unit, or any combination thereof of the input unit. In one embodiment, a stream of information associated with the input unit includes a cost function ("cost"). The cost of the stream of information may be calculated for each of the candidate units of a pool. The crux of the problem is that no single combination (set) of streams of information associated with the input units, for example cost functions ("costs") will be optimal for all concatenations.

The concatenation may be understood as an act of drawing a candidate unit from a pool 204 of candidate units and placing the candidate unit next to a previous unit, coupling and/or linking of the candidate unit with the previous unit. If, for example, at a particular concatenation all potential candidate units have the same duration, the stream of information that represents duration may not have substantial value in the ranking and selection process. If, on the other hand, at another concatenation all potential candidate units have otherwise similar characteristics (streams of information) but differ greatly in their duration, the stream of information that represent duration may be critical to selection of the best unit at this concatenation. Thus, attempting to find optimal cost weights on a global basis, as is currently done, is essentially counter-productive (regardless of the approach considered).

Method 300 continues with operation 302 that involves analyzing the streams of information in a context associated with a pool of candidate units for the input unit, for example pool 204, to determine a distribution of the streams of information over the pool. For example, analyzing of the streams of information may include weighting a stream of information of the streams of information higher if the first stream of information provides a high discrimination between the candidate units, and weighting a stream of information of the streams of information lower if the stream of information provides a low discrimination between the candidate units.

Method continues with operation 303 that involves determine a set of weights of the streams of information based on the distribution. In one embodiment, during speech synthesis, each of the streams of information (characteristics) are dynamically weighted in real-time based on the distribution of these characteristics within a given set of input units (e.g., a sentence) being synthesized. In one embodiment, it is determined which streams of information for the candidate units in the pool vary the most, and weighting the streams of information according to how much variation there is for that stream of information in the pool of candidate units. For example, if the units in a pool have the same pitch, but vary in another characteristic, for example, in duration, then that other characteristic will be given more weight in choosing the right unit from the pool of candidate units to use for the speech synthesis. That is, the weightings of the streams of information for pools of candidate units can be varied and tailored to a particular stream of information for the candidate units in the pool, as described in further detail below.

Method continues with operation 304 that involves selecting a candidate unit from the candidate units based on the set of weights of the streams of information, as described in further details below. At operation 305 the selected candidate unit can be concatenated with a previously selected candidate unit (if any). At operation 306 a determination is made whether a next candidate unit needs to be concatenated with a previous unit, such as the unit selected at operation 304. If there is a next unit to be concatenated with the previously selected candidate unit, method 300 returns to operation 301 to receive streams of information associated with the next input unit. Further, the streams of information are analyzed in the context associated with a pool of candidate units for the next input unit at operation 302. In one embodiment, the distribution of the streams of information over the candidate units associated with the next input unit is determined. A set of weights of the streams of information associated with the candidate units for the next input unit is determined according to the distribution at operation 303. A next candidate unit for the next input unit is selected from the pool of the candidate units to concatenate with the previously selected candidate unit based on the set of weights of the streams of information associated with the candidate units for the next input unit at operation 304, as described in further detail below. At operation 305 the next selected candidate unit is concatenated with the previously selected candidate unit. If there is no next unit to be selected, method 300 ends at block 307.

Figure 4:
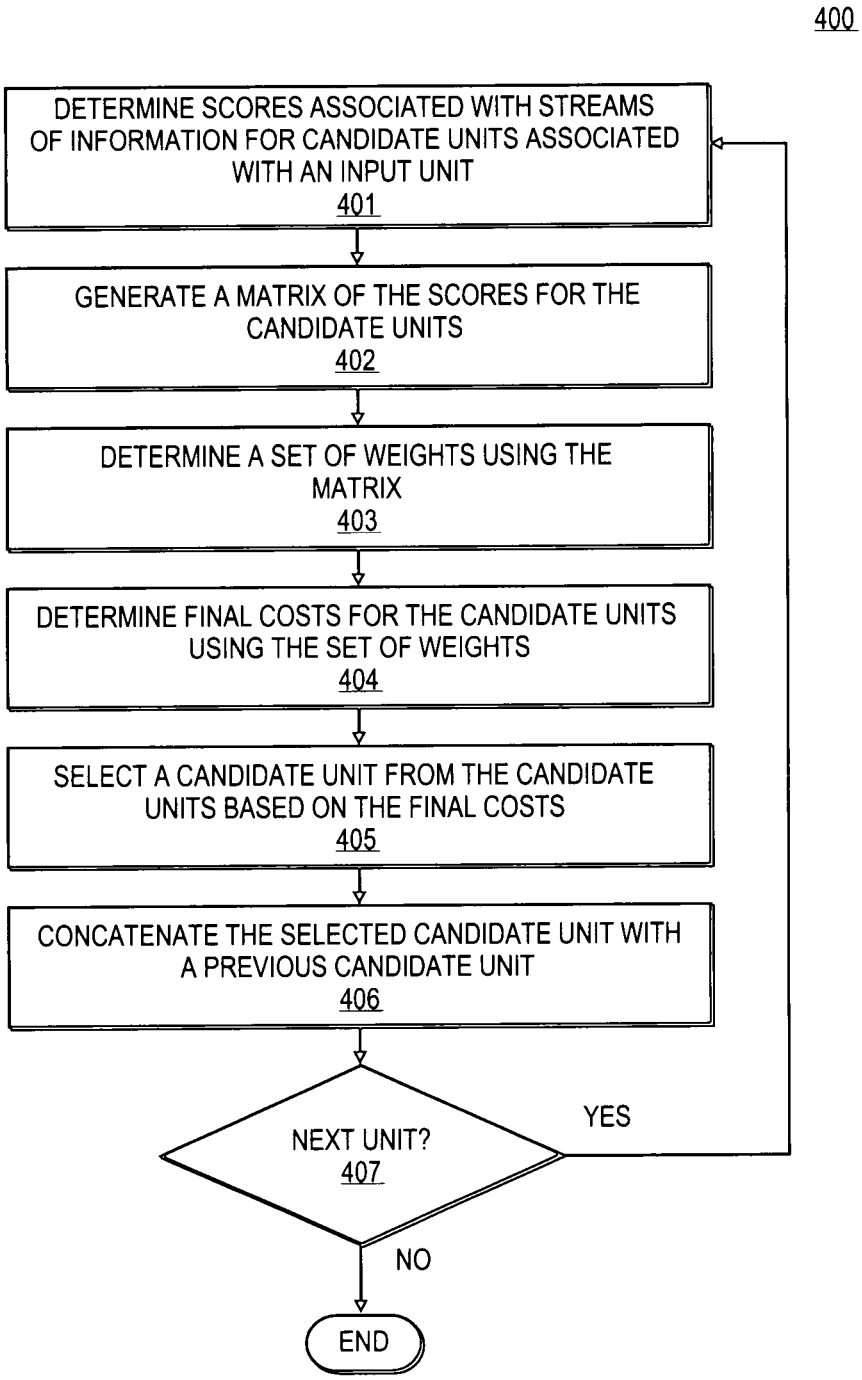
FIG. 4 shows a flowchart of another embodiment of a method to perform a content-aware unit selection for natural language processing.

FIG. 4 shows a flowchart of another embodiment of a method to perform a content-aware unit selection for natural language processing. Method begins with operation 401 that involves determining scores associated with streams of information for first candidate units. The first candidate units may be associated with a first input unit of a sequence of input units. In one embodiment, determining the scores associated with the streams of information for first candidate units includes determining the cost functions (costs) of the streams of information for each candidate unit. The final cost of the set of streams of information for a candidate unit may be determined based on the individual costs of each of the streams of information for the candidate unit. For example, there may be a cost for smoothness (concatenation cost) that typically indicates how well the candidate unit attaches to a previous candidate unit, is there going to be a discontinuity, and if so, how salient is it. There may be a cost for pitch, for example, that indicates how well the pitch in the candidate unit matches the pitch that is required in the new input sequence of units (e.g., sentence).

For example, for a given concatenation, all potential candidate units may be collected from a pool stored, for example, in a voice table. Then, for each such candidate unit, all scores associated with various streams of information may be computed. For example, a concatenation score may be computed that measures how the candidate unit fits with the previous unit, a pitch score may be computed that reflects how close the candidate unit is to the desired pitch contour, a duration score may be computed that measures how close the duration is to the desired duration, etc. That is, the scores associated with the streams of information are determined across all candidate units of the pool on a per concatenation basis. In one embodiment, the scores are individually normalized across all potential candidate units from the pool. In one embodiment, the scores are arranged into an input matrix. Method continues with operation 402 that involves generating a matrix of the scores for the candidate units.

Figure 5A:
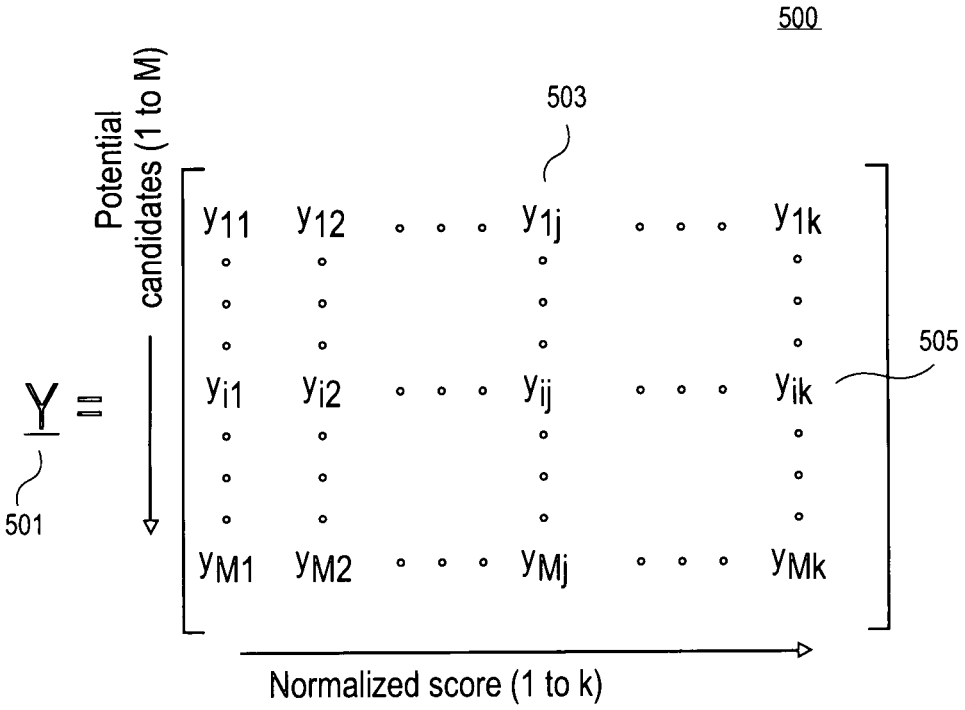
FIG. 5A illustrates one embodiment of forming a matrix of scores for candidate units.

FIG. 5A illustrates one embodiment of forming a matrix Y of the scores for the candidate units. For example, a pool stored, for example, in a voice table, contains N possible candidate units, for example, candidate words "apple" at a particular point in the synthesis process, for example, at each concatenation. Each of M candidate units has associated streams of information that represent, for example, pitch, duration, accent, and the like.

For each candidate unit K different scores may be computed that are associated with each of the streams of information that may represent a different aspect of perceptual quality (pitch, duration, etc.). Each of these scores typically corresponds to a non-negative cost penalty. Each of the individual scores may be normalized across all N candidate units to the range [0, 1], through subtraction of the minimum value and division by the maximum value. As shown in FIG. 5, a (M×K) matrix Y (501) of scores yij is constructed, where rows 1 to M, such as a row 505, correspond to candidate units, and columns 1 to K, such as a column 503 corresponds to a normalized score. M may be as high as a few tens of thousands, while K is typically less than 20.

The normalized score distributions obtained across all potential candidates for each stream of information may be dynamically leveraged. In one embodiment, the streams of information that have greater variation of the scores resulting in a high discrimination between potential candidate units of the pool are locally rewarded by assigning a greater weight, and the streams of information that have less variation of the scores and therefore are less discriminative are penalized, for example, by assigning a lesser weight. In one embodiment, a constrained quadratic optimization is performed to find the optimal set of weights in the linear combination of all the scores available, as described in further detail below. A final cost so obtained is then used in the ranking and selection procedure carried out in unit selection text-to-speech (TTS) synthesis, as described in further detail below.

Referring back to FIG. 4, method 400 continues with operation 403 that involves determining a set of weights using the matrix, such as matrix Y (501). In one embodiment, determining the set of weights includes maximizing the final costs for the first candidate units, as described in further detail below. The final costs can be obtained via linear combination of the scores yij in Y (501), where the weights are unknown. For example, matrix multiplication with an unknown weight vector can be performed that yields the final costs for all candidate units.

Figure 5B:
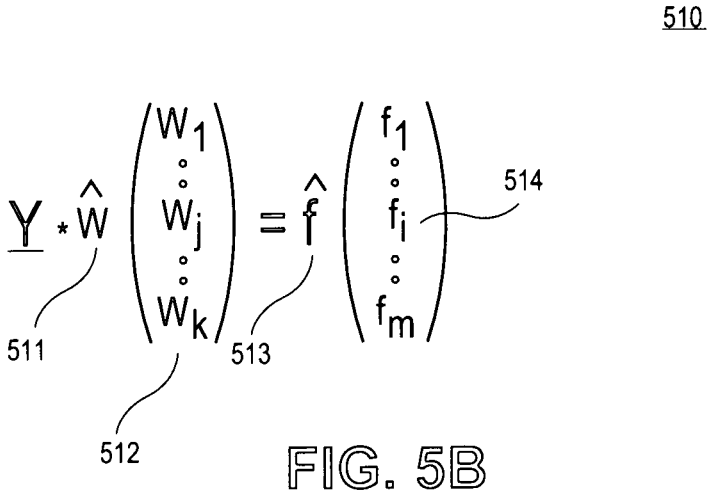
FIG. 5B illustrates one embodiment of matrix multiplication with an unknown weight vector that yields final costs.

In matrix form:

$$Y\,w=f \tag{1}$$

where f (513) is a vector of final costs $f_i$ (514) for all candidate units ($1 \le i \le M$), and w (511) is a vector of desired weights $w_j$(512) ($1 \le j \le K$) for the streams of information, as shown in FIG. 5B. Element 514 of vector 513 is a final cost for $i^{th}$ candidate unit, as shown in FIG. 5B. In one embodiment, solving the quadratic problem associated with (1) results in the optimal weight vector at this concatenation.

In one embodiment, a candidate unit may be selected at any given point (e.g., at any concatenation) from a set of candidate units which are as distinct from one another as they possibly can, to achieve the greatest degree of discrimination between them. In other words, we would like to find the smallest final cost among that set of final costs fi where individual fi's are as uniformly large as possible. This is a classic minimax problem that involves finding a minimum amongst a set that has been maximized. For example, the minimum final cost fi is found in the final cost vector f which has maximum norm. That is, a minimum needs to be found amongst a set of final costs that has been maximized.

As such, the norm of final cost vector f is maximized. The weights of the streams of information may be chosen to maximize the norm of the final cost vector. By maximizing the norm of the final cost vector, the weights may be made as big as possible. By making the weights as big as possible the importance of each of the streams is maximized as much as possible. That fills the dynamic range of the streams of information as best as possible to discriminate between the candidate units. Once the norm of the final cost vector f is maximized, the minimum cost is chosen among the uniformly largest costs. For example, the stream of information that represents a pitch is maximized to a maximum value and becomes important. But if all candidate units have the substantially the same maximum value pitch, the pitch is not relevant for the purpose of discriminating between the candidate units. Therefore, the smallest final cost needs to be picked among uniformly large final costs, because the smallest final cost means the candidate unit that achieves the best fit.

First, the norm of f is maximized, for example:

$$\|f\|^2=w^TY^TYw=w^TQw,$$

where $Q=Y^TY$, subject to the (linear combination) constraints that:

$$\|w\|^2=w^Tw=1, \tag{3}$$

$$w_j>0,\ 1 \le j \le K. \tag{4}$$

The constraint (3) indicates that sum of all weights is equal one. Constraint (4) indicates that weights are positive, meaning that contribution from the stream of information should be positive.

Without the positivity constraint (4), this would be a standard quadratic optimization problem. The requirement that the weights all be positive (constraint (4)), however, may considerably complicate the mathematical outlook. To make the problem tractable, this requirement is first relaxed, and the resulting solution is modified to take it into account. As set forth below, this does not affect the suitability of the solution for the purpose intended.

When constraint (4) is relaxed, weights may be negative. A negative weight means that a particular direction in the eigenvalue space (stream of information) is important with a negative correlation. The amplitude represented, for example, by a square of a weight, an absolute value of a weight, provides an indication about a degree of importance of the stream of information.

Next, the component in the above maximal norm of vector f (2) which has minimal value, is selected. That is, the candidate unit is selected that is associated with the minimal costs.

Note that the (K×K) matrix Q is real, symmetric, and positive definite, which means there exist matrices P and Λ such that:

$$Q=P\Lambda P^T, \tag{5}$$

where P is the orthomormal matrix of eigenvectors $P_j$(meaning that $P^TP=PP^T=I_K$, where $I_K$ is the identity matrix of dimension K) and Λ is the diagonal matrix of eigenvalues $\lambda_j$, $1\leq j\leq K$.

Let us now (temporarily) ignore the $w_j>0$ constraint. From the Rayleigh-Ritz theorem, we know that the maximum of $w^TQw$ with $w^Tw=1$ is given by the largest eigenvalue of Q, i.e., $\lambda_{max}$, and that this maximum is achieved when w is set equal to the associated eigenvector, $p_{max}$. This solution for W may not be appropriate for a weight vector, because the elements of $p_{max}$ are not, in general non-negative. The elements of eigenvector $p_{max}$ may represent weights of the streams of information.

On the other hand, the coordinates of $p_{max}$, by definition, reflect the relative contribution of each of the original axes (i.e., streams of information) to the direction that best explains the input data (i.e., the scores gathered for each stream). It is therefore reasonable to expect that a simple transformation of these coordinates, such as absolute value or squaring, would produce non-negative weights with much of the qualitative behavior sought. That is, the signs of $p_j$ eigenvectors do not matter for weighting the stream of information. Therefore, the signs can be ignored, and the squares of $p_j$ eigenvectors may be taken to get positive values.

Following this reasoning, we set the optimal weight vector w* to be:

$$w^*=p_{max}\cdot p_{max}, \tag{6}$$

Where "·" denotes component-by-component multiplication. Clearly, this solution satisfies all the constraints (3)-(4). The associated final cost vector is then obtained as:

$$Yw^*=f^*, \tag{7}$$

which finally leads to the index of the best candidate at the concatenation considered:

$$i^*=\arg\min f_i^* \tag{8}$$

$$1\leq i\leq M$$

As shown in (8) the candidate which has the minimum final cost is selected.

Interestingly, a side benefit of this approach is that the resulting final cost vector f* is automatically normalized to the range [0,1], which makes the entire unit selection process more consistent across the various concatenations considered, for example, in the Viterbi search.

Referring back to FIG. 4, method continues with operation 404 that involves determining final costs for the candidate units of the pool using the set of weights. A candidate unit is selected from the pool of the candidate units based on the final costs at operation 405. In one embodiment, the candidate unit is selected that has a minimal final cost, as described above with respect to equation (8). Next, at operation 406 (optional) the selected candidate unit is concatenated with a previously selected candidate unit.

At operation 407 a determination is made whether a next candidate unit needs to be concatenated with a previous unit, such as the unit selected at operation 405. If there is a next unit to be concatenated with the previously selected candidate unit, method 400 returns to operation 401 to determine scores associated with streams of information for next candidate units associated with a next input unit. A next matrix of the scores for the next candidate units may be generated at operation 402. A next set of weights may be determined using the next matrix at operation 403. Next final costs for next candidate units may be determined using the next set of weights at operation 404. A next candidate unit from the next candidate units may be selected based on the next final costs at operation 405. The next selected candidate unit is then concatenated with the previously selected candidate unit at operation 406. If there is no next unit to be selected, method 400 ends at block 408.

An evaluation of methods, as described above, was conducted using a database, such as a voice table that is currently being developed on MacOS X®. The voice table was constructed from over 10,000 utterances carefully spoken by an adult male speaker. One of these utterances was the sentence "Bottom lines are much shorter". Because of that, the focus of an initial experiment was the sentence "Bottom lines are much longer", which only differs in the last word, and has otherwise similar pitch and duration patterns as the original utterance "Bottom lines are much shorter". Because the two sentences are so close, it was expected that the (word-based) unit selection procedure would pull the first four words out of the original sentence "Bottom lines are much shorter", and only take the last word from some other material (utterance).

However, this is not what was observed with the baseline standard system using a linear score combination with manually adjusted weights, as described above. Instead, only the first two words "Bottom lines" were picked from the original sentence. The words "are" and "much" were selected from other material. Such selection may be a result of a potentially deleterious effect of global weighting technique used in the standard system. That is, the standard system is not optimal to select the candidate units of at least a portion of the sentence.

Then, the candidate units were selected for sentence "Bottom lines are much longer" using context-aware optimal cost weighting approach for unit selection, as described above. For each unit in the sentence, all possible candidates were extracted from the voice table, such as M=16 (for "Bottom"), M=10 (for "lines"), M=796 (for "are"), M=92 (for "much"), and M=11 (for "longer") words, respectively. Each time (for example, at each concatenation), K=4 streams of information were considered, namely: (i) the concatenation cost calculated between the candidate and the previous unit, (ii) the pitch cost calculated between the ideal pitch contour and that of the candidate, (iii) the duration cost calculated between the ideal duration and that of the candidate, and (iv) the position cost calculated between the ideal location within the utterance and that of the candidate. The (M×K) input matrix was formed in each case, and the optimal weights and final costs were computed, as detailed above.

This resulted in the same candidates being ultimately selected for the words "Bottom", "lines", and "longer". This time, however, different candidates were picked for both "are" and "much", namely the contiguous candidates that we had originally expected to be chosen, whereas the candidates selected by the baseline system were relegated to ranks 15 and 17, respectively.

Figure 6:
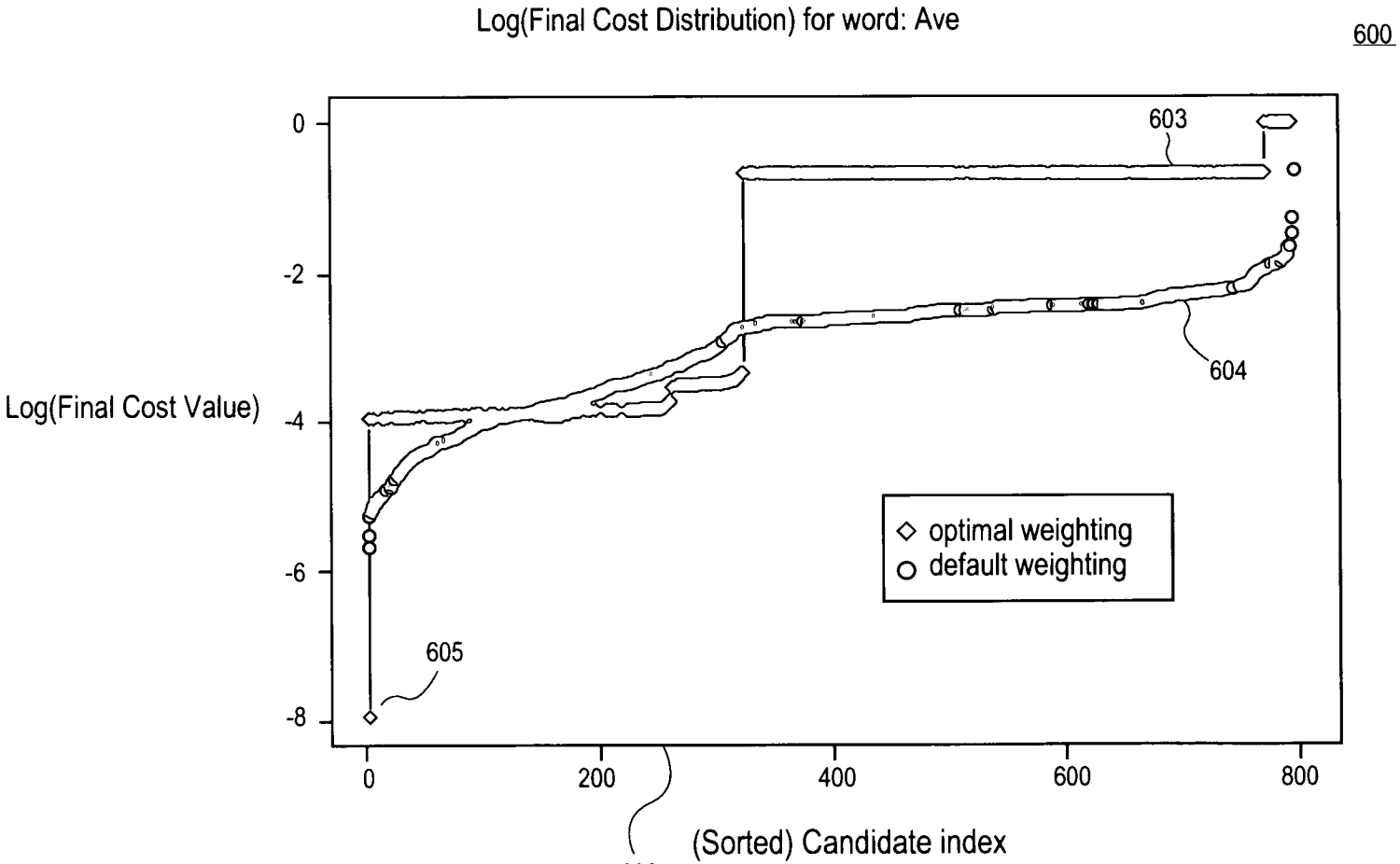
FIG. 6 illustrates the sorted final costs for word "are", for both context-aware optimal cost weighting and standard (default) weighting.

FIG. 6 illustrates the sorted final costs for word "are", for both context-aware optimal cost weighting and standard (default) weighting. FIG. 6 illustrates a plot of final cost values 601 versus candidate index 602 for default weighting 604 and optimal weighting 603. As shown in FIG. 6, in the optimal weighting 603, the contiguous candidate has a much lower cost 605 than any non-contiguous candidates, reflecting a much greater emphasis on the concatenation score. That is, contiguous candidate "are" from the sentence "bottom lines are shorter" having the lowest final cost 605 was selected using the context-aware optimal cost weighting. The optimal weighting provides high level of discrimination between the selected candidate having lowest final cost 605 and any other candidate, as shown in FIG. 6.

In the default weighting 604 the weighting vector was [0.125 (concatenation cost), 0.5 (pitch cost), 0.25 (duration cost), 0.125 (position cost)], thereby mostly emphasizing pitch, whereas in the optimal case it changed to [0.98(concatenation cost), 0,0 (pitch cost), 02 (duration cost), 0 (position cost)], thereby heavily weighting contiguity. This seems intuitively reasonable, as for this function word co-articulation was always somewhat noticeable, while the pitch contours for all candidates were very close to each other anyway.

Even though for some of the words the same candidates were ultimately picked, the optimal weight vectors returned by the context-aware optimum cost weighting algorithm were markedly different as well.

Figure 7:
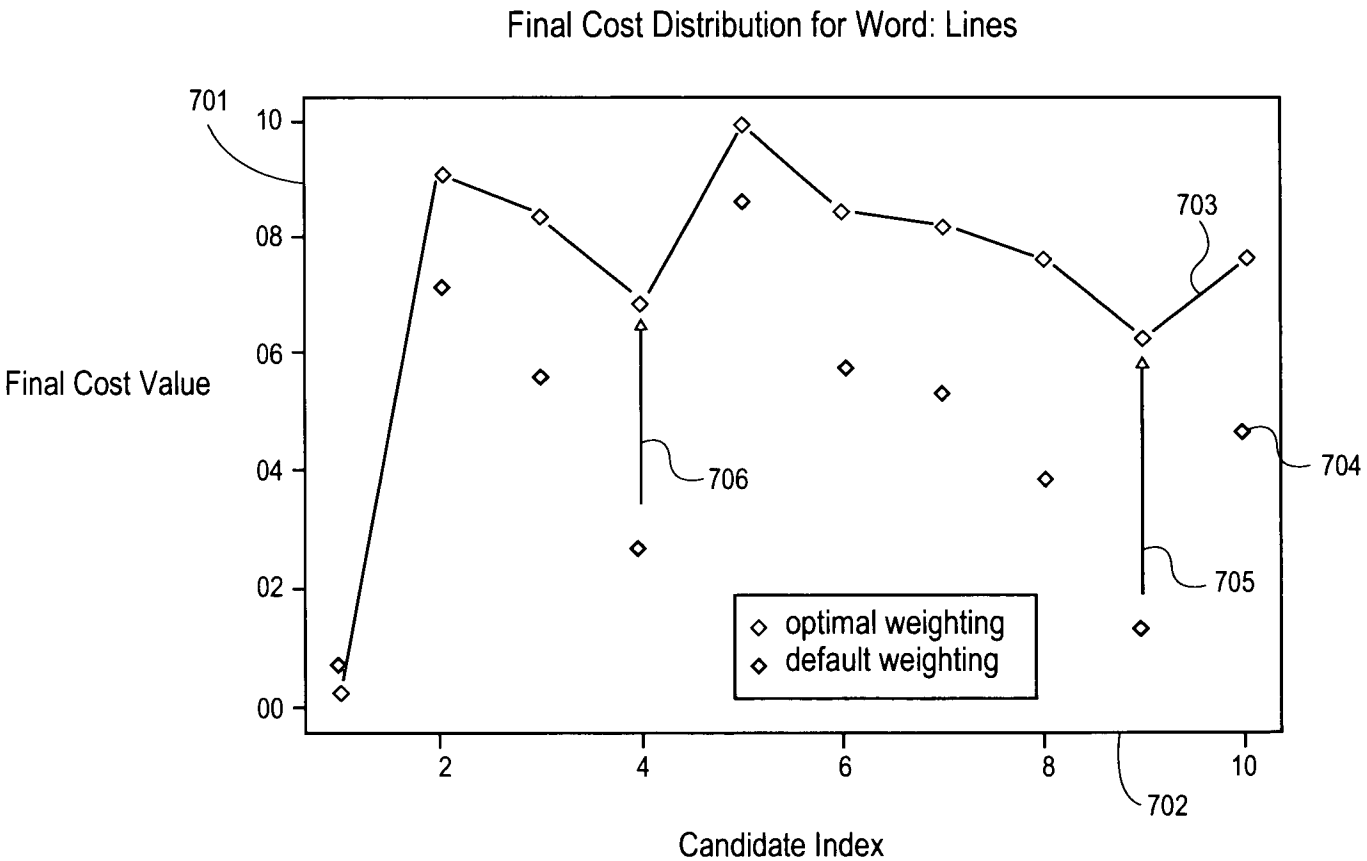
FIG. 7 illustrates the sorted final costs for word "lines", for both context-aware optimal cost weighting and standard (default) weighting.

FIG. 7 illustrates the sorted final costs for word "lines", for both context-aware optimal cost weighting and standard (default) weighting. A plot of final cost values 701 is shown in FIG. 7 versus candidate index 702 for default weighting 704 and optimal weighting 703. For example, for "lines", the weight vector changed from [0.125(concatenation cost), 0.5 (pitch cost), 0.25 (duration cost), 0.125(position cost)] to [0.61(concatenation cost), 0.21(pitch cost), 0.18 (duration cost), 0(position cost)]. That is, in the optimal weighting 703 the weights in a combination (set) of the streams of information are redistributed such that concatenation (e.g., stream of information that represents contiguity) becomes most important. FIG. 7, which compares the resulting (unsorted) final cost distributions 704 and 704, makes it quite clear that the new weights lead to a much better discrimination between, for example, Candidate 1 and Candidate 9. As shown in FIG. 7, the difference in score between Candidate 9 and Candidate 1 substantially increases 705 for optimal weighting 703 relative to default weighting 705. Finally, although in the previous two examples contiguity was clearly deemed the most dominant aspect of unit selection, this was not systematically the case.

Figure 8:
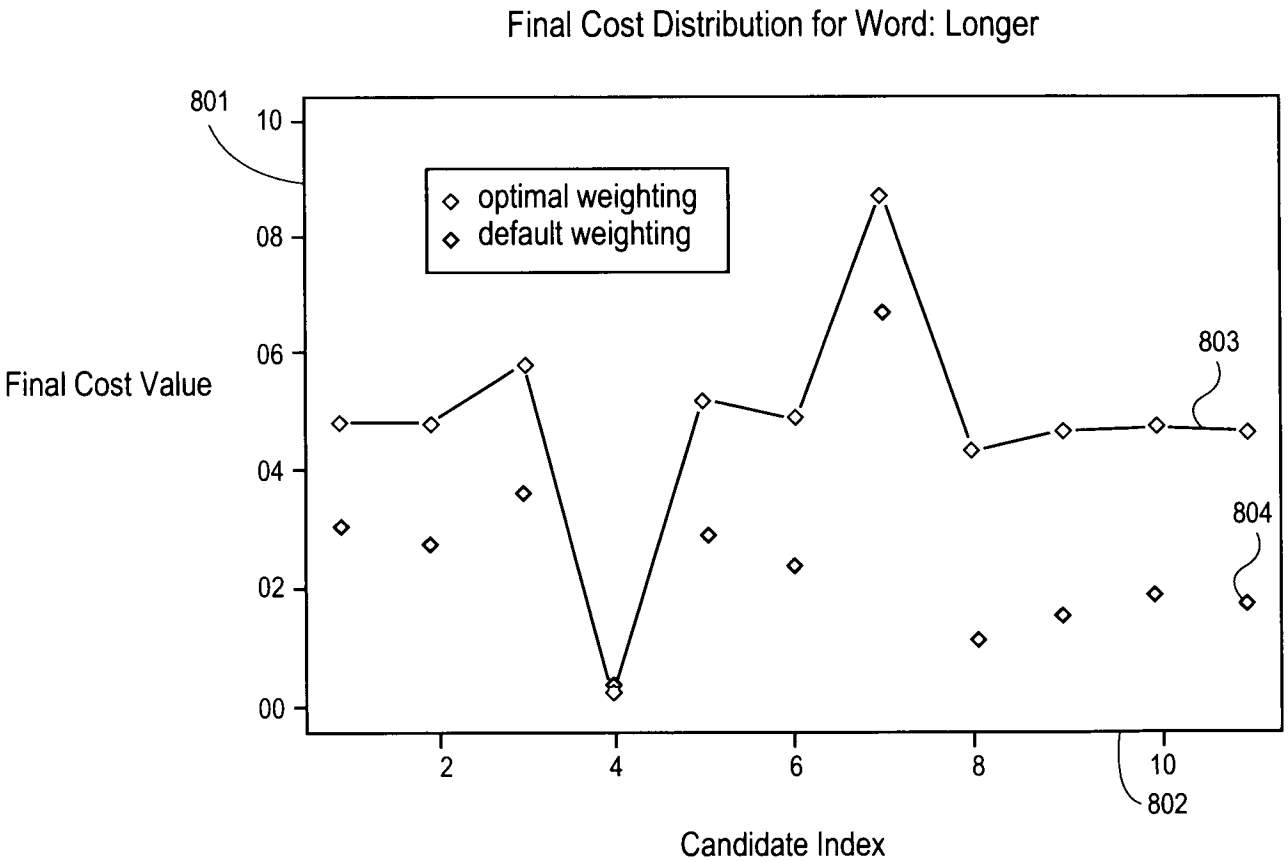
FIG. 8 illustrates the sorted final costs for word "longer", for both context-aware optimal cost weighting and standard (default) weighting.

FIG. 8 illustrates the sorted final costs for word "longer", for both context-aware optimal cost weighting and standard (default) weighting. A plot of final cost values 801 is shown in FIG. 8 versus candidate index 802 for default weighting 804 and optimal weighting 803. For "longer", the weight vector changed from (0.125,0.5,0.25,0.125) to (0,0.15,0.15,0.7). In this case the most discriminative score was the position within the utterance (reflecting, here, the fact that the candidate was the last word in the sentence, which again makes a great deal of intuitive sense). That is, in the optimal weighting 803 the weights in a combination (set) of the streams of information are redistributed such that position (e.g., stream of information that represents position) becomes most important. FIG. 8, which compares the resulting (unsorted) final cost distributions, makes it quite clear that the new weights lead to a much better discrimination between, for example, Candidate 4 and Candidate 8.

Consistent results were obtained when performing the same kind of evaluation on other sentences from the same database. This bodes well for the viability of the proposed approach when it comes to determining context-aware optimal weights in concatenative text-to-speech synthesis.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "processing", "computing", "calculating", "determining" and the like, refer to the action and processes of a data processing system, or similar electronic computing device, that manipulates and transforms data represented as physical (electronic) quantities within the data processing system's registers and memories into other data similarly represented as physical quantities within the data processing system memories or registers or other such information storage, transmission or display devices.

The algorithms and displays presented herein are not inherently related to any particular computer or other apparatus. Various general-purpose systems may be used with programs in accordance with the teachings herein, or it may prove convenient to construct more specialized apparatus to perform the required method operations. The required structure for a variety of these systems will appear from the description below. In addition, embodiments of the present invention are not described with reference to any particular programming language. It will be appreciated that a variety of programming languages may be used to implement the teachings of embodiments of the invention as described herein.

In the foregoing specification, embodiments of the invention have been described with reference to specific exemplary embodiments thereof. It will be evident that various modifications may be made thereto without departing from the broader spirit and scope of the invention. The specification and drawings are, accordingly, to be regarded in an illustrative sense rather than a restrictive sense.

What is claimed is:

1. A machine-implemented method of text-to-speech generation, comprising:

at a device comprising one or more processors and memory:

receiving a text input to be converted to speech, the text input including a sequence of text input units; and for each text input unit of the sequence of text input units:

selecting, from a pool of pre-recorded segments of speech, a respective plurality of candidate speech units for the text input unit, wherein the respective plurality of candidate speech units differ from one another in regard to one or more of a plurality of characteristics;

for each of the plurality of characteristics, determining a respective degree of variation present among the respective plurality of candidate speech units selected from the pool of pre-recorded segments of speech;

determining a respective weight set for the text input unit, the respective weight set including a respective weight for each of the plurality of characteristics based on relative magnitudes of the respective degrees of variations that are present among the candidate speech units for the plurality of characteristics; and based on the respective weight set for the text input unit, selecting a respective one of the respective plurality of candidate speech units to synthesize a respective speech output corresponding to the text input unit.

2. The machine-implemented method of claim 1, further comprising:

concatenating the respective speech outputs selected for the sequence of text input units as a respective speech output corresponding to the text input.

3. The machine-implemented method of claim 1, wherein determining the respective weight set for the input text unit further comprises:

weighting a first characteristic higher than a second characteristic in the respective weight set for the plurality of characteristics if the first characteristic provides a higher discrimination between the plurality of candidate speech units for the first text input unit.

4. The machine-implemented method of claim 1, wherein determining the respective weight set for the input text unit further comprises:

performing a constrained quadratic optimization to find the respective weight set for the first input text unit, wherein the constrained quadratic optimization maximizes a respective conversion cost associated with each of the respective plurality of candidate speech units for the text input unit.

5. The machine-implemented method of claim 4, wherein the selected one of the respective plurality of candidate speech units is a speech unit associated a minimum conversion cost among the maximized respective conversion costs of the plurality of candidate speech units.

6. The machine-implemented method of claim 1, wherein the plurality of characteristics include two or more of pitch, duration, position, accent, spectral quality, and part-of-speech.

7. The machine-implemented method of claim 1, wherein selecting one of the plurality of candidate speech units as a speech output is further based on respective values of the plurality of characteristics belonging to each of the respective plurality of candidate speech units.

8. A non-transitory computer-readable medium having instructions stored thereon, the instruction, when executed by one or more processors, cause the processors to perform operations comprising:

receiving a text input to be converted to speech, the text input including a sequence of text input units; and for each text input unit of the sequence of text input units:

selecting, from a pool of pre-recorded segments of speech, a respective plurality of candidate speech units for the text input unit, wherein the respective plurality of candidate speech units differ from one another in regard to one or more of a plurality of characteristics;

for each of the plurality of characteristics, determining a respective degree of variation present among the respective plurality of candidate speech units selected from the pool of pre-recorded segments of speech;

determining a respective weight set for the text input unit, the respective weight set including a respective weight for each of the plurality of characteristics based on relative magnitudes of the respective degrees of variations that are present among the candidate speech units for the plurality of characteristics; and based on the respective weight set for the text input unit, selecting a respective one of the respective plurality of candidate speech units to synthesize a respective speech output corresponding to the text input unit.

9. The computer-readable medium of claim 8, wherein the operations further comprise:

concatenating the respective speech outputs selected for the sequence of text input units as a respective speech output corresponding to the text input.

10. The computer-readable medium of claim 8, wherein determining the respective weight set for the input text unit further comprises:

weighting a first characteristic higher than a second characteristic in the respective weight set for the plurality of characteristics if the first characteristic provides a higher discrimination between the plurality of candidate speech units for the text input unit.

11. The computer-readable medium of claim 8, wherein determining the respective weight set for the input text unit further comprises:

performing a constrained quadratic optimization to find the respective weight set for the input text unit, wherein the constrained quadratic optimization maximizes a respective final conversion cost associated with each of the respective plurality of candidate speech units for the text input unit.

12. The computer-readable medium of claim 11, wherein the selected one of the respective plurality of candidate speech units is a speech unit associated a minimum conversion cost among the maximized respective conversion costs of the plurality of candidate speech units.

13. The computer-readable medium of claim 8, wherein the plurality of characteristics include two or more of pitch, duration, position, accent, spectral quality, and part-of-speech.

14. The computer-readable medium of claim 8, selecting one of the plurality of candidate speech units as a speech output is further based on respective values of the plurality of characteristics belonging to each of the respective plurality of candidate speech units.

15. A system, comprising:

one or more processors; and memory having instructions stored thereon, the instructions, when executed by the one or more processors, cause the one or more processors to perform operations comprising:

receiving a text input to be converted to speech, the text input including a sequence of text input units; and for each text input unit of the sequence of text input units:

selecting, from a pool of pre-recorded segments of speech, a respective plurality of candidate speech units for the text input unit, wherein the respective plurality of candidate speech units differ from one another in regard to one or more of a plurality of characteristics;

for each of the plurality of characteristics, determining a respective degree of variation present among the respective plurality of candidate speech units selected from the pool of pre-recorded segments of speech;

determining a respective weight set for the text input unit, the respective weight set including a respective weight for each of the plurality of characteristics based on relative magnitudes of the respective degrees of variations that are present among the candidate speech units for the plurality of characteristics; and based on the respective weight set for the text input unit, selecting a respective one of the respective plurality of candidate speech units to synthesize a respective speech output corresponding to the text input unit.

16. The system of claim 15, wherein the operations further comprise:

concatenating the respective speech outputs selected for the sequence of text input units as a respective speech output corresponding to the text input.

17. The system of claim 15, wherein determining the respective weight set for the input text unit further comprises:

weighting a first characteristic higher than a second characteristic in the respective weight set for the plurality of characteristics if the first characteristic provides a higher discrimination between the plurality of candidate speech units for the first text input unit.

18. The system of claim 15, wherein determining the respective weight set for the input text unit further comprises:

performing a constrained quadratic optimization to find the respective weight set for the first input text unit, wherein the constrained quadratic optimization maximizes a respective conversion cost associated with each of the respective plurality of candidate speech units for the first text input unit.

19. The system of claim 18, wherein the selected one of the respective plurality of candidate speech units is a speech unit associated a minimum conversion cost among the maximized respective conversion costs of the plurality of candidate speech units.

20. The system of claim 15, wherein the plurality of characteristics include two or more of pitch, duration, position, accent, spectral quality, and part-of-speech.

21. The system of claim 15, wherein selecting one of the plurality of candidate speech units as a speech output is further based on respective values of the plurality of characteristic belonging to each of the respective plurality of candidate speech units.

* * * * *